US012790942B2

(12) United States Patent
Mathieson, III

(10) Patent No.: US 12,790,942 B2
(45) Date of Patent: Nov. 10, 2026

(54) OIL WELL DRILLING SYSTEM UTILIZING SURVEY OPTIMIZATION

(71) Applicant: Bench Tree Group, LLC, Georgetown, TX (US)

(72) Inventor: James Price Mathieson, III, The Woodlands, TX (US)

(73) Assignee: Bench Tree Group, LLC, Georgetown, TX (US)

( * ) Notice: Subject to any disclaimer, the term of this patent is extended or adjusted under 35 U.S.C. 154(b) by 0 days.

(21) Appl. No.: 19/334,140

(22) Filed: Sep. 19, 2025

(65) Prior Publication Data

US 2026/0078670 A1 Mar. 19, 2026

Related U.S. Application Data

(60) Provisional application No. 63/696,550, filed on Sep. 19, 2024.

(51) Int. Cl.

| | |
|---|---|
| ***E21B 47/12*** | (2012.01) |
| ***E21B 7/04*** | (2006.01) |
| ***E21B 47/02*** | (2006.01) |

(52) U.S. Cl.

CPC ..... *E21B 47/12* (2013.01); *E21B 7/04* (2013.01); *E21B 47/02* (2013.01)

(58) Field of Classification Search

CPC ..... E21B 47/12; E21B 7/04; E21B 47/02

See application file for complete search history.

(56) References Cited

U.S. PATENT DOCUMENTS

| | | | | |
|---|---|---|---|---|
| 2006/0045178 | A1* | 3/2006 | Schu | H03M 7/30 375/240.01 |
| 2016/0290128 | A1* | 10/2016 | Dugas | E21B 47/20 |
| 2025/0230745 | A1* | 7/2025 | Miller | E21B 47/12 |

OTHER PUBLICATIONS

Henning e al., Sensor Data Compression Based on Re-Quantization of Sensor Data, IEEE International Symposium on Smart Electronic Systems (iSES), 2018: 98-103. (Year: 2018).*

* cited by examiner

*Primary Examiner* — Shelby A Turner
*Assistant Examiner* — Xiuqin Sun
(74) *Attorney, Agent, or Firm* — DUNLAP CODDING, P.C.

(57) ABSTRACT

A system comprising: a bottom hole assembly having a MWD tool comprising: a wireless telemetry module; sensor(s); a MWD processor; and medium storing instructions that when executed by the MWD processor cause the MWD processor to: obtain, from the sensor(s), a measurement value of a downhole parameter; determine an encoding format for the measurement value by comparing the measurement value to at least two ranges with each range associated with a separate encoding format having a compression level; apply the determined encoding format to the measurement value to generate a compressed measurement value; and transmit, utilizing the wireless telemetry module using wireless telemetry, the compressed measurement value; and a surface computer system configured to decode the compressed measurement value and utilize the decoded measurement value.

20 Claims, 8 Drawing Sheets

OIL WELL DRILLING SYSTEM UTILIZING SURVEY OPTIMIZATION

CROSS-REFERENCE TO RELATED APPLICATIONS

This application claims the benefit of and priority to the provisional patent application identified by U.S. Ser. No. 63/696,550, filed Sep. 19, 2025, titled "OIL WELL DRILLING SYSTEM UTILIZING SURVEY OPTIMIZATION", the entire content of which is hereby expressly incorporated herein by reference.

BACKGROUND

The recovery of hydrocarbons from subterranean zones relies on the process of drilling wellbores. Typically, the process uses drilling equipment situated at the earth's surface with a drill string extending from the surface equipment to the formation or subterranean zone of interest. The drill string can extend thousands of feet below the surface. The terminal end of the drill string includes a drill bit for drilling (or extending) the wellbore. In addition to this conventional drilling equipment, drilling systems also rely on some sort of drilling fluid, in most cases a drilling "mud" which is pumped through the inside of the drill string, cooling and lubricating the drill bit, and then exiting out of the drill bit and carrying rock cuttings back to surface. The mud also helps control bottom hole pressure and prevent hydrocarbon influx from the formation into the wellbore, which can potentially cause a blow out at the surface.

Directional drilling is the process of steering the drilling of a well away from vertical to intersect a target endpoint or follow a prescribed path. At the terminal end of the drill string is a bottom-hole-assembly ("BHA") which typically comprises: 1) a drill bit; 2) a steerable downhole mud motor or rotary steerable system; 3) sensors or survey equipment (for example, Logging While Drilling ("LWD") and/or Measurement-while-drilling (MWD)) to evaluate downhole conditions as depth of the well progresses; 4) equipment for telemetry of data to the surface; and 5) other control mechanisms such as stabilizers or heavy weight drill collars. The BHA is conveyed into the wellbore by a drill pipe.

As an example of a potential drilling activity, MWD equipment is used to provide downhole sensor and status information to surface in a near real-time mode while drilling. This information is used by the rig crew to make decisions about controlling and steering the well to optimize the drilling speed and trajectory based on numerous factors, including lease boundaries, locations of existing wells, formation properties, and hydrocarbon size and location. This can include making intentional deviations from an originally-planned wellbore path as necessary based on the information gathered from the downhole sensors during the drilling process. The ability to obtain real-time data during MWD allows for a relatively more economical and more efficient drilling operation.

In both directional and straight (or vertical) holes, the position of the well must be known with reasonable accuracy to ensure the correct well trajectory. While extending the wellbore, evaluation of physical properties such as pressure, temperature, and the wellbore trajectory in three-dimensional space are important. The measurements include inclination from vertical and azimuth (compass heading). Measurements are typically made at discrete points with the general path of the wellbore computed from these points.

In downhole MWD, the MWD tool surveys the well as it is drilled, and sensor information, including information regarding the orientation of the drill bit, is relayed back to the driller on surface. Measurement devices of the MWD tool typically include a series of accelerometers which measure the inclination of the MWD tool (for example, vertical is 0° inclination and horizontal is 90° inclination) and magnetometers which measure the earth's magnetic field to determine azimuth. A typical Directional and Inclination (D&I) sensor package may include three single-axis accelerometers in each of the three orthogonal axes, together with two dual axes magnetometers, yielding the three orthogonal axes and one redundant axis, which is typically not used. The sensor package also includes associated data acquisition and processing circuitry. The accelerometers and magnetometers are arranged in three mutually orthogonal directions, and measure the three mutually orthogonal components of the Earth's magnetic field and Earth's gravity. The accelerometer typically comprises a quartz crystal suspended in an electromagnetic field; measuring the inclination by how much electromagnetic force is required to maintain the crystal in balance. The accelerometers provide measurement of deviation from vertical, or inclination, as well as providing a measurement of the tool face or rotational orientation of the tool. The magnetometers provide a measure of the direction or magnetic heading as well as its orientation when the BHA is at or near vertical.

These sets of measurements assist the driller for steering as well as for computing location. In most cases, when another length of drill pipe is added to the drill string, a survey (one or more measurements, such as a set of measurements) is taken and the information is sent to surface and decoded by the MWD's operator and converted to information the driller requires for survey calculations. The BHA position may be calculated by assuming a certain trajectory between the surveying points.

In most downhole operations, it is often necessary to insert or introduce gauges, sensors, or testing instrumentation into the borehole in order to obtain information regarding borehole parameters and conditions. Such parameters might include, but are not limited to, temperature, pressure, directional parameters, and gamma radiation. The electrical componentry of the various sensors and gauges used to obtain the information are mounted on, or near, circuit boards which are contained within an apparatus. The circuit boards may be referred or positionally favored to one side of the carrier apparatus. The gauges are typically protected as they are imbedded in the wall, and hence completely housed, within the apparatus.

In MWD, known MWD tools contain essentially the same D&I sensor package to survey the well bore, but the data may be sent back to surface by various telemetry methods. Such telemetry methods include, but are not limited to, the use of hardwired drill pipe, acoustic telemetry, fiber optic cable, Mud Pulse (MP) Telemetry, and Electromagnetic (EM) Telemetry. In some downhole drilling operations, there may be more than one telemetry system used to provide a backup system in case one of the wellbore telemetry systems fails or is otherwise unable to function properly. The sensors used in the MWD tools are usually located in an electronics probe or instrumentation assembly contained in a cylindrical cover or housing, located near the drill bit.

Mud-pulse telemetry, for instance, allow surveys to be transmitted to the surface. However, transmitting the surveys to the surface takes time. The transmission of the data may take several minutes, depending on the depth of the sensors and the type of transmission equipment used. It is desirable to reduce survey transmission times. Either way, faster survey transmission times is an important metric used to evaluate directional companies, and provides a competitive advantage. The past work has mainly focused on increasing data rates rather than encoding data more efficiently.

Drilling efficiency is paramount and operators scrutinize every second of downtime to maximize the amount of time spent actively drilling. Currently, a typical directional well can require two hundred or more surveys, each potentially taking minutes to transmit, which results in many hours of time spent waiting on surveys and not actively drilling, or drilling without the data needed to effectively guide the drill bit and produce the desired wellbore. Therefore, technical solutions for the problem in the form of systems and methods are needed that reduce the amount of time that each survey requires to be transmitted, thereby increasing the amount of time available for drilling, and lowering the well cost for the operator.

SUMMARY

In one embodiment, a method is provided, comprising obtaining, using one or more sensors of a measurement-while-drilling (MWD) tool of a bottom-hole-assembly in a wellbore, a measurement value of a downhole parameter, the measurement value being within a full possible range for the measurement value having a first number of discrete values within the full possible range and having a first resolution indicative of a difference in quantity between each of the discrete values within the full possible range, wherein a bigger difference results in a lesser resolution and wherein a smaller difference results in a greater resolution, wherein the full possible range is associated with a transmission length level based on a first number of bits needed to transmit the measurement value, the first number of bits indicative of a minimum number of bits needed in a combination of bits in order to assign a unique combination of bits to each of the first number of discrete values; determining, with a processor of the MWD tool, an encoding format having a compression level for the measurement value by: comparing the measurement value to one or more predefined ranges within the full possible range, with each predefined range associated with a separate encoding format, each predefined range having a corresponding second number of predefined discrete values defining the predefined range, wherein the compression level of each encoding format is indicative of a corresponding second number of bits needed to transmit the measurement value, wherein the second number of bits is less than the first number of bits; and choosing the encoding format associated with the predefined range with the smallest size into which the measurement value fits of the one or more predefined ranges; applying, with the processor of the MWD Tool, the determined encoding format to the measurement value to generate a compressed measurement value; transmitting, with a wireless telemetry module of the bottom-hole-assembly using wireless telemetry, the compressed measurement value; and decoding, with a processor of a computer outside of the well, the compressed measurement value.

In some embodiments, the method comprises: obtaining, using the one or more sensors, a second measurement value; determining, with a processor of the MWD tool, an encoding format having a compression level for the second measurement value by comparing the second measurement value to one or more predefined ranges within a full possible range for the second measurement value, with each predefined range associated with a separate encoding format, wherein the compression level of each encoding format for the second measurement value is indicative of a corresponding third number of bits needed to transmit the second measurement value, wherein for each compression level the third number of bits is indicative of a minimum number of bits needed in order to assign a unique combination of bits to each of a third number of predefined values defining the predefined range for that compression level; comparing the compression level of the determined encoding format level for the second measurement value to the compression level of the first measurement value by comparing the second number of bits to the third number of bits; changing the determined encoding format for the second measurement value to a second encoding format for the second measurement value having a different compression level, such that the third number of bits equals the second number of bits; applying the second encoding format to the second measurement value to generate a second compressed measurement value; and transmitting, with the wireless telemetry module of the bottom-hole-assembly using wireless telemetry, the second compressed measurement value.

In some embodiments, a group of two or more measurement values may be encoded using a shared compression format. Each measurement value is first evaluated independently to determine the most efficient compression format that can represent its value within a valid encoding range. Among these individually selected formats, the system identifies the least efficient format—that is, the one with the broadest range—and applies it uniformly to all values in the group. This shared format ensures that each value can be efficiently encoded without exceeding its allowable range. A decode key is then generated and transmitted to indicate the compression format used for the group, enabling the surface system to correctly interpret the encoded values.

In some embodiments, the method comprises: obtaining, using the one or more sensors, a set of measurement values; determining, with the processor of the MWD tool, that the range of at least one measurement value of the set of measurement values meets a predetermined acceptable range; flagging, with the processor of the MWD tool, one or more measurement values of the set of measurement values with the range that meets the predetermined acceptable range, with one or more data flags; generating the set decode key to include the one or more data flags; and decoding, with the processor outside of the well, the one or more data flags using the set decode key, thereby determining which of the one or more measurement values are flagged.

In some embodiments, certain compression levels can be designated as representing an "acceptable range" rather than transmitting a specific quantitative value. In other words, when a variable's measured value falls within a predefined acceptable range, the system assigns a compression level that corresponds to that range. In this scenario, no actual measurement data needs to be sent beyond the decode key itself. The decode key, when it indicates that this particular compression level is in use, effectively signals to the surface system that the variable is within the predefined acceptable range. As a result, the system does not need to receive a separate numeric value, thus optimizing transmission efficiency while ensuring that the surface software can still interpret the data accurately.

In some embodiments, a method is provided, comprising: obtaining, using one or more sensors in a measurement-while-drilling (MWD) tool of a bottom-hole-assembly in a wellbore, a set of measurement values; determining, with a processor of the MWD tool, an encoding format of each measurement value of the set of measurement values, each of the determined encoding formats comprising a range and comprising a compression level designed to encode the corresponding measurement value at a required resolution; applying, with the processor of the MWD tool, the corresponding determined encoding format to each of the measurement values of the set of measurement values to generate a compressed measurement value for each of the measurement values; generating, with the processor of the MWD tool, a set decode key based on the encoding formats; transmitting, with a wireless telemetry module of the bottom-hole-assembly using wireless telemetry, the set decode key and the compressed measurement values; and decoding, with a processor outside of the well, the compressed measurement values using the set decode key.

In some embodiments, a method is provided, comprising: obtaining, using one or more sensors in a measurement-while-drilling (MWD) tool of a bottom-hole-assembly in a well, a set of measurement values; determining, with a processor of the MWD tool, an encoding format of each measurement value of the set of measurement values, each of the determined encoding formats comprising a range and comprising a compression level designed to encode the corresponding measurement value at a required resolution; applying, with the processor of the MWD tool, the corresponding determined encoding format to each of the measurement values of the set of measurement values to generate a compressed measurement value for each of the measurement values; generating, with the processor of the MWD tool, two or more decode keys based on the encoding formats; transmitting, with a wireless telemetry module of the bottom-hole-assembly using wireless telemetry, the two or more decode keys and the compressed measurement values; and decoding, with a processor outside of the well, the compressed measurement values using the two or more decode keys.

In some embodiments, a method is provided, comprising: obtaining, using one or more sensors in a measurement-while-drilling (MWD) tool of a bottom-hole-assembly in a wellbore, one or more measurement values; determining, with a processor of the MWD tool, that the one or more measurement values meets a predetermined acceptable range; generating, with the processor of the MWD tool, a data flag indicative of the one or more measurement values meeting the predetermined acceptable range; transmitting, with a wireless telemetry module of the bottom-hole-assembly using wireless telemetry, the data flag; and decoding, with a processor outside of the well, the data flag, thereby determining that a current range of the measurement values meets the predetermined acceptable range, without receiving the one or more measurement values from the processor of the MWD tool.

In some embodiments, a system is provided, the system comprising: a bottom hole assembly comprising a measurement-while-drilling (MWD) tool comprising: a wireless telemetry module; one or more sensors; a MWD processor; and one or more nontransitory computer readable medium storing instructions that when executed by the MWD processor cause the MWD processor to: obtain, from the one or more sensors, a measurement value of a downhole parameter; determine an encoding format for the measurement value by comparing the measurement value to at least two ranges with each range associated with a separate encoding format having a compression level; apply the determined encoding format to the measurement value to generate a compressed measurement value; and transmit, utilizing the wireless telemetry module using wireless telemetry, the compressed measurement value; and a surface computer system having one or more processors configured to: decode the compressed measurement value; and utilize the decoded measurement value to determine an orientation of a wellbore.

Embodiments of the above techniques include methods, apparatus, systems, networks, and computer program products. One such computer program product is suitably embodied in one or more non-transitory machine-readable media that stores instructions executable by one or more processors. The instructions are configured to cause the one or more processors to perform the above-described actions.

The details of one or more embodiments of the subject matter of this specification are set forth in the accompanying drawings and the description below. Other aspects, features, and advantages will become apparent from the description, the drawings, and the claims.

BRIEF DESCRIPTION OF THE DRAWINGS

The accompanying drawings, which are incorporated in and constitute a part of this specification, illustrate one or more embodiments described herein and, together with the description, explain these embodiments. The drawings are not intended to be drawn to scale, and certain features and certain views of the figures may be shown exaggerated, to scale, or in schematic in the interest of clarity and conciseness. Not every component may be labeled in every drawing. Like reference numerals in the figures may represent and refer to the same or similar element or function.

DETAILED DESCRIPTION

Figure 1:
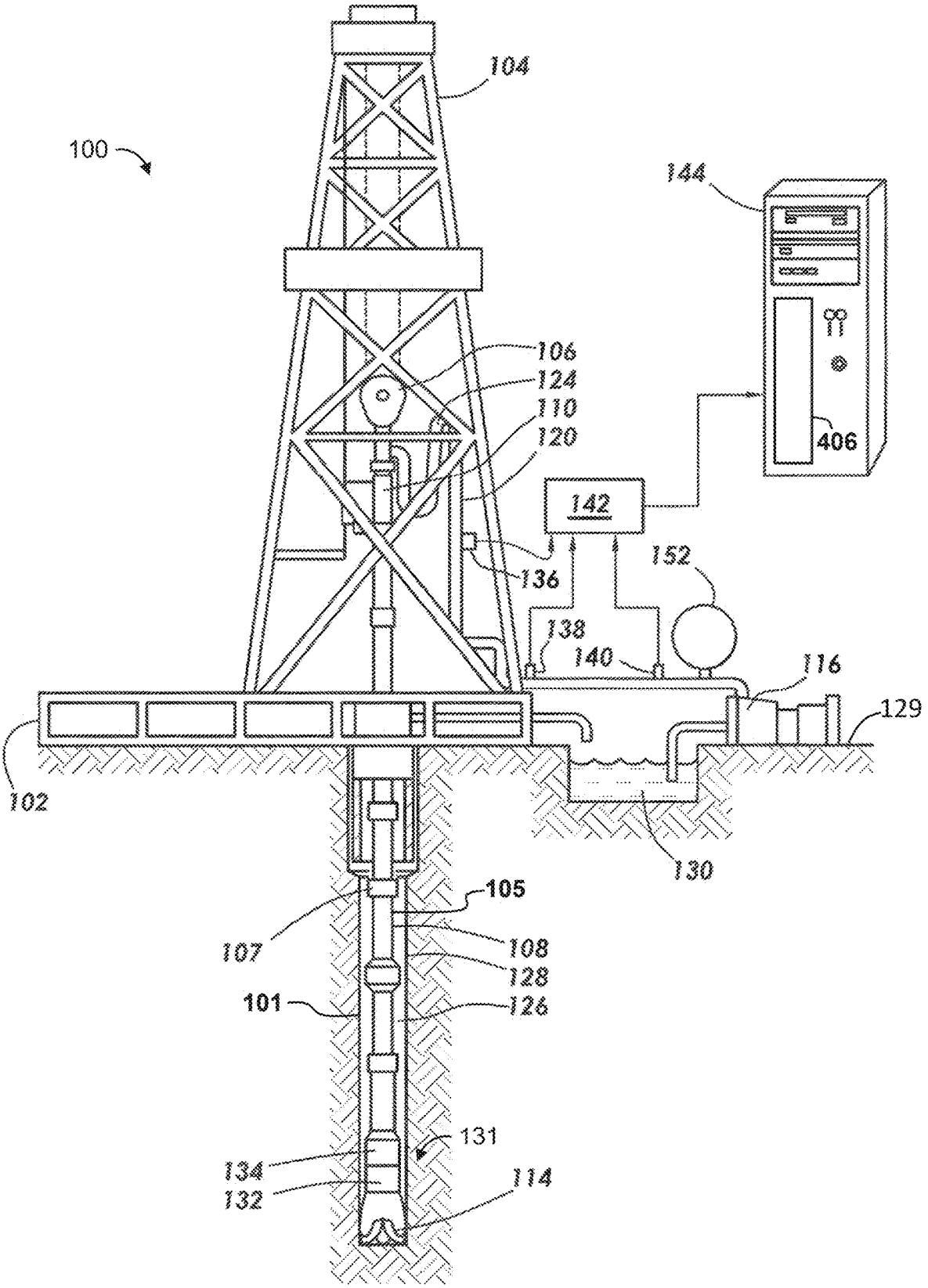
FIG. 1 illustrates an exemplary drilling system configured to transmit survey measurements in less time than current systems without sacrificing resolution or accuracy of the survey in accordance with the present disclosure.

The following detailed description of exemplary embodiments refers to the accompanying drawings. The same reference numbers in different drawings may identify the same or similar elements.

Before explaining at least one embodiment of the disclosure in detail, it is to be understood that the disclosure is not limited in its application to the details of construction, experiments, exemplary data, and/or the arrangement of the components set forth in the following description or illustrated in the drawings unless otherwise noted.

The disclosure is capable of other embodiments or of being practiced or carried out in various ways. Also, it is to be understood that the phraseology and terminology employed herein are for purposes of description and should not be regarded as limiting.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or more and the singular also includes the plural unless it is obvious that it is meant otherwise. Further, use of the term "plurality" is meant to convey "more than one" unless expressly stated to the contrary.

As used herein, qualifiers like "about," "approximately," and combinations and variations thereof, are intended to include not only the exact amount or value that they qualify, but also some slight deviations therefrom, which may be due to manufacturing tolerances, measurement error, wear and tear, stresses exerted on various parts, and combinations thereof, for example.

The use of the term "at least one" or "one or more" will be understood to include one as well as any quantity more than one. In addition, the use of the phrase "at least one of X, Y, and Z" will be understood to include X alone, Y alone, and Z alone, as well as any combination of X, Y, and Z.

The use of ordinal number terminology (i.e., "first", "second", "third", "fourth", etc.) is solely for the purpose of differentiating between two or more items and, unless explicitly stated otherwise, is not meant to imply any sequence or order or importance to one item over another or any order of addition.

As used herein, any reference to "one embodiment," "an embodiment," "some embodiments," "one embodiment," "some embodiments," "an embodiment," "one example," "for example," or "an example" means that a particular element, feature, structure, or characteristic described in connection with the embodiment/embodiment/example is included in at least one embodiment/embodiment/example and may be used in conjunction with other embodiments/embodiments/examples. The appearance of the phrase "in some embodiments" or "one example" or "in some embodiments" in various places in the specification does not necessarily all refer to the same embodiment/embodiment/example, for example.

Circuitry, as used herein, may be analog and/or digital components referred to herein as "blocks", or one or more suitably programmed processors (e.g., microprocessors) and associated hardware and software, or hardwired logic. Also, "components" or "blocks" may perform one or more functions. The term "component" or "block" may include hardware, such as a processor (e.g., a microprocessor), a combination of hardware and software, and/or the like. Software may include one or more processor-executable instructions that when executed by one or more components cause the component to perform a specified function. It should be understood that the algorithms described herein may be stored on one or more non-transitory memory. Exemplary non-transitory memory may include random access memory, read-only memory, flash memory, and/or the like. Such non-transitory memory may be electrically based, optically based, and/or the like.

Software may include one or more processor-readable instruction that when executed by one or more component, e.g., a processor, causes the component to perform a specified function. It should be understood that the algorithms described herein may be stored on one or more non-transitory processor-readable medium, which is also referred to herein as a non-transitory memory. Exemplary non-transitory processor-readable mediums may include random-access memory (RAM), a read-only memory (ROM), a flash memory, and/or a non-volatile memory such as, for example, a CD-ROM, a hard drive, a solid-state drive, a flash drive, a memory card, a DVD-ROM, a Blu-ray Disk, a disk, and an optical drive, combinations thereof, and/or the like. Such non-transitory processor-readable media may be electrically based, optically based, magnetically based, and/or the like. Further, the messages described herein may be generated by the components and result in various physical transformations.

As used herein, the terms "network-based," "cloud-based," and any variations thereof, are intended to include the provision of configurable computational resources on demand via interfacing with a computer and/or computer network, with software and/or data at least partially located on a computer and/or computer network.

Compression Levels for Individual Measurements:

Individual measurements (e.g. Gravity) have multiple, predefined ranges, each with the necessary number of bits required to yield a desired resolution. The highest (most compressed) compression level that has sufficient range to accommodate the measurement may be used to encode and telemeter that measurement. The "Decode Key" (indicating which compression level was used) and the compressed value for that measurement may then be telemetered.

Shared Compression Levels for Sets of Measurements:

Multiple individual measurements, each with their own multiple, predefined ranges may be included in a set. Each measurement may be individually evaluated to determine the highest compression level that has enough range to accommodate it. In some embodiments, the compression level used for the set may then be determined to be the lowest of the previously determined compression level needed for any individual measurement, such that all values may be transmitted at a single, shared compression level and the ranges at that compression level will accommodate all values in the set. In some embodiments, a single "Decode Key" may then be sent to a surface computer system for the entire set along with each of the compressed values for the individual measurements within that set.

Flags:

In some embodiments, a compression level for an individual measurement can be designated as an acceptable range rather than a quantitative value. For example, Gravity's highest level of compression, Compression Level 1, might be set up as anything between 0.995 and 1.005. If set up quantitatively, then a reading of 1.000 would qualify for Compression Level 1, a Decode Key indicating Compression Level 1 would be telemetered, the compressed value would be telemetered, and the surface computer would decode a 1.000. If instead Compression Level 1 was designated as an acceptable range (or a "Flag"), then that same value of 1.000 would still fall in Compression Level 1. The Decode Key indicating Compression Level 1 would still be telemetered, but the transmission could then stop there. Because the surface computer system knows that Compression Level was predefined as an "Acceptable Range," when a surface decoder of the surface computer system sees Compression Level 1 is being used, the surface decoder knows that Gravity must be within the predefined acceptable range, so no further bits are necessary. It simply displays that value as being acceptable.

In some embodiments, a mix of Compression Level types can be used for an Individual Measurement. For example, in the above case Compression Levels 2-4 for Gravity could be quantitative, so that if Gravity fell in the Acceptable Range, Compression Level 1 was used and just that it was acceptable was transmitted, but if it fell outside that range, the appropriate compression level was determined and the exact value was transmitted.

Referring now to the drawings, and in particular to FIG. 1, shown therein is an exemplary embodiment of a drilling system 100 constructed in accordance with the present disclosure. The drilling system 100 may be provided with a drilling platform 102 which may include a derrick 104 associated with a hoist 106. Drilling of a borehole 101, which may be a hydrocarbon borehole, for instance, is carried out by a string of drill pipes 105 (only one of which is numbered in FIG. 1) connected together by "tool joints" 107 (only one of which is numbered in FIG. 1) so as to form a drill string 108. The borehole 101 may also be referred to as wellbore 101. In the exemplary drilling system 100, the hoist 106 suspends a top drive 110 that is used to rotate the drill string 108 as the drill string 108 is being lowered into the borehole 101. In some cases, the drill string 108 may be turned by a drive unit (not shown) built into or on the floor of the drilling platform 102. Connected to the lower end of the drill string 108 is a drill bit 114. Drilling is accomplished by rotating the drill bit 114, either by the top drive 110 rotating the drill string 108, a downhole motor (not shown) rotating the drill bit 114, or both. During operation of the drilling system 100, drilling fluid pressure may fluctuate and may contain "noise" from several sources (e.g., bit noise, torque noise, and mud pump noise). To counteract this noise, in some embodiments the drilling system 100 may be provided with a dampener 152 to reduce noise.

Drilling fluid may be pumped by a mud pump 116 through a stand pipe 120, a goose neck 124, the top drive 110, and down through the drill string 108 at high pressures and volumes to emerge through nozzles or jets in the drill bit 114 and/or drive the downhole motor. The drilling fluid then travels back up the borehole 101 via an annulus 126 formed between the exterior of the drill string 108 and a borehole wall 128, through a blowout preventer (not shown), and into a mud pit 130 on the Earth's surface 129. On the surface 129, the drilling fluid may be cleaned and then circulated again by mud pump 116. The drilling fluid may be used to cool the drill bit 114, to carry cuttings to the surface 129, and to balance hydrostatic pressure in rock formations surrounding the borehole 101.

The drilling system 100 may comprise a bottom-hole-assembly 131 ("BHA 131") which may include the drill bit 114 and a measurement-while-drilling (MWD) tool 134 (hereinafter "MWD tool 134"). The MWD tool 134 may include a wireless telemetry module 132 ("WTM 132"). In some embodiments, the wireless telemetry module 132 may be, or may be part of, a pulser system. In some embodiments, the bottom-hole-assembly 131 may also include a steerable downhole mud motor or rotary steerable system (not shown) and other control mechanisms such as stabilizers or heavy weight drill collars (not shown).

Figure 2:
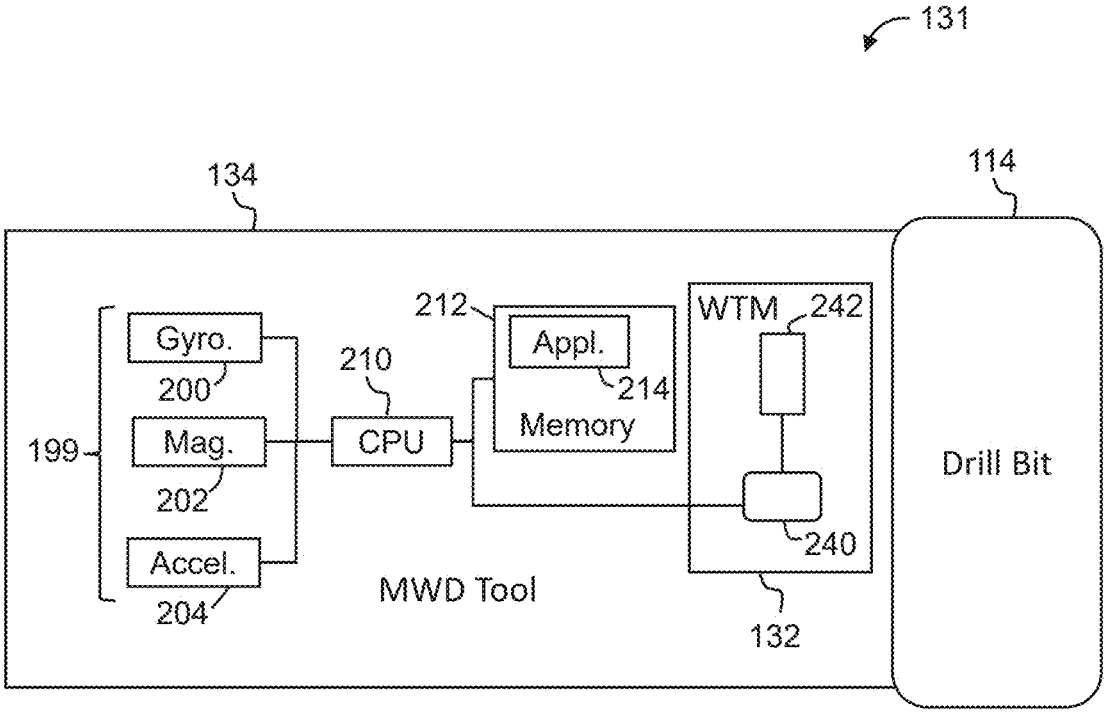
FIG. 2 is a block diagram of an exemplary downhole assembly that may be used with the drilling system of FIG. 1, constructed in accordance with the present disclosure.

As illustrated in FIG. 2, the MWD tool 134 may be used to collect data regarding formation properties and/or various drilling parameters. The MWD tool 134 may comprise one or more sensors 199 configured to collect measurement values. In some embodiments, the measurement values may be raw data and/or the result of calculations using data from the sensors 199. Nonexclusive examples of the one or more sensors 199 include one or more gyroscopes 200, one or more magnetometers 202, and/or one or more accelerometers 204, that gather data that is used to determine at least an inclination and azimuth of the drill bit 114, and thus the borehole 101, for the borehole 101 being drilled. The sensors 199 may also include thermometers, voltmeters, gamma sensors, and/or other sensors. In some embodiments, the measurement values may be indicative of one or more of: inclination of the drill bit 114, the azimuth of the drill bit 114, a magnetic field strength at the current location of the drill bit 114, a gravitational field strength at the current location of the drill bit 114, and a dip angle of a formation at the current location of the drill bit 114. Two or more of the measurement values (such as measurement values that are indicative of inclination, azimuth, magnetic field strength, gravitational field strength, and/or dip angle) may be considered a set of measurement values which may be referred to as a survey.

As used herein, inclination refers to an angle of the borehole 101 with respect to vertical, and azimuth refers to an angle of direction of the borehole 101 with respect to North on a horizontal plane. For example, when the borehole 101 is completely vertical, the inclination is 0° and the azimuth is undefined. When the borehole 101 takes a turn, the inclination begins changing from zero and, for many directional drilling operations, may eventually end up at 90° (horizontal). When the borehole 101 changes direction from vertical, the azimuth describes the direction of that change (e.g., if the borehole 101 direction is going North, the azimuth is 0°, if the direction is going East, the azimuth is 90°, if the direction is going South, the azimuth is 180°, and if the direction is going West, the azimuth is 270°, etc.). Inclination is measured by degrees in a range from 0° (vertical direction going down) to 180° (vertical going up). The azimuth is measured by degrees in a range between 0° and 360°, with both 0° and 360° meaning a North direction.

The MWD tool 134 may also comprise one or more processors 210 (which may be referred to as "processor 210") and non-transitory computer readable memories 212 (hereinafter "memory 212") storing one or more software application 214 that includes executable instructions configured to cause the one or more processors 210 to perform the actions described herein. In some embodiments, the one or more processors 210 may comprise one or more processors 210 working together, or independently, to read and/or execute processor executable code and/or data, such as stored in the memory 212. The one or more processors 210 may be capable of creating, manipulating, retrieving, altering, and/or storing data structures into the memory 212.

Exemplary embodiments of the one or more processors 210 of the MWD tool 134 may include, but are not limited to, a digital signal processor (DSP), a central processing unit (CPU), a field programmable gate array (FPGA), a microprocessor, a multi-core processor, an application specific integrated circuit (ASIC), combinations, thereof, and/or the like, for example. The one or more processors 210 may be capable of communicating with the memory 212 via a data bus, for instance.

The memory 212 of the MWD tool 134 may store the application 214 that, when executed by the one or more processors 210, causes the MWD tool 134 to perform an action such as communicate with, or control, one or more components of the drilling system 100.

In some embodiments, the memory 212 of the MWD tool 134 may have a data store that may store data such as, but not limited to, structured data from relational databases, semi-structured data, unstructured data, time-series data, and binary data. The data store may be a data base, a remote accessible storage, or a distributed filesystem. In one embodiment, the data store may be a time-series database, a relational database or a non-relational database. Examples of such databases comprise, DB2® by IBM, Microsoft® Access, Microsoft® SQL Server, Oracle®, mySQL, PostgreSQL, MongoDB, Apache Cassandra, InfluxDB by InfluxData, Prometheus, Redis, Elasticsearch by Elastic N.V., TimescaleDB by TigerData, and/or the like. It should be understood that these examples have been provided for the purposes of illustration only and should not be construed as limiting the presently disclosed inventive concepts.

The MWD tool 134 may include and/or be coupled to the wireless telemetry module 132. The wireless telemetry module 132 may be configured to transmit gathered data from the sensors 199 and/or other data to the surface, such as data representing a survey. The wireless telemetry module 132 may modulate a flow resistance of drilling fluid within the drill string 108 to generate pressure pulses that propagate to the surface 129 at designated pulse widths. In an exemplary embodiment, the wireless telemetry module 132 may be provided with a motor 240 configured to actuate a valve 242 to generate the pressure pulses. It should be noted, however, that the wireless telemetry module 132 may be any mud-pulse system capable of generating pressure pulses in drilling mud to transmit data.

Returning now to FIG. 1, one or more transducers, such as first transducer 136, second transducer 138, and third transducer 140, may convert the pressure pulses into electrical signals for a signal digitizer 142 (which may be an analog-to-digital converter, for instance). While three transducers (the first, second, and third transducers 136, 138, and 140) are illustrated, a greater number of transducers, or fewer transducers (e.g., one transducer), may be used.

Figure 3:
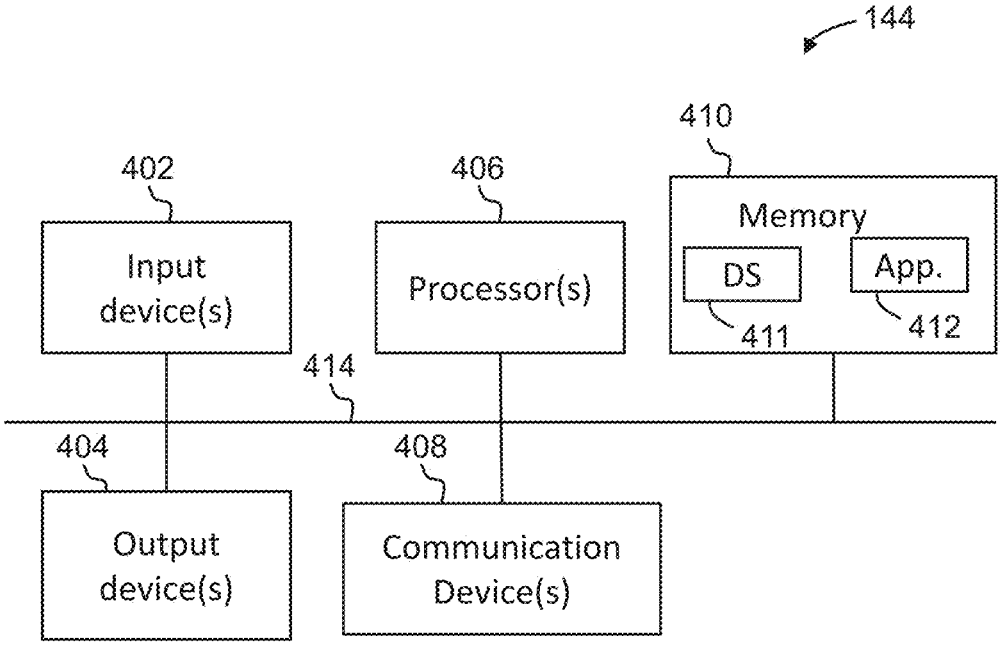
FIG. 3 is a block diagram of an exemplary embodiment of a computer system shown in FIG. 1 and constructed in accordance with the present disclosure.

As shown in FIGS. 1 and 3, the drilling system 100 may comprise and/or be connected to a surface computer system 144 (which may be referred to as a surface computer or as a computer outside of the well) located outside of the well borehole 101. The signal digitizer 142 may supply a digital form of the pressure pulses to the surface computer system 144 and/or to another form of a data processing device. As shown in FIG. 3, the surface computer system 144 operates in accordance with software (such as application 412) which may be stored on a non-transitory computer-readable memory 410 configured to cause one or more processors 406 (which may be referred to as processor 406) to decode the received pulses. The resulting telemetry data may be further analyzed and processed by the surface computer system 144 and/or other data processing device to generate an output of information. For example, an operator of the drilling system 100 could use the information output by the surface computer system 144 to obtain and monitor position and orientation information for the BHA 131, drilling parameters, and formation properties (e.g., natural gamma), for instance.

Referring to FIG. 3, shown therein is a diagram of an exemplary embodiment of the surface computer system 144 constructed in accordance with the present disclosure. In some embodiments, the surface computer system 144 may include, but is not limited to, embodiments as a pluggable computer housed in a network chassis, a personal computer, a cellular telephone, a smart phone, a network-capable television set, a tablet, a laptop computer, a desktop computer, a network-capable handheld device, a server, a digital video recorder, a wearable network-capable device, a virtual reality/augmented reality device, and/or the like.

In some embodiments, the surface computer system 144 may include one or more input devices 402 (hereinafter "input device 402"), one or more output devices 404 (hereinafter "output device 404"), the one or more processors 406 (hereinafter "processor 406"), one or more communication devices 408 (hereinafter "communication device 408"), one or more non-transitory processor-readable medium 410 (hereinafter "computer system memory 410") storing processor-executable code and/or software application(s) 412, for example including, a web browser capable of accessing a website and/or communicating information and/or data over a wireless or wired network (e.g., a communication channel), and/or the like, and a database. The input device 402, the output device 404, the processor 406, the communication device 408, and the computer system memory 410 may be connected via a path 414 (such as a data bus) that permits communication among the components of the surface computer system 144.

In some embodiments, the processor 406 of the surface computer system 144 may comprise one or more processors 406 working together, or independently, to read and/or execute processor executable code and/or data, such as stored in the computer system memory 410. The processor 406 may be capable of creating, manipulating, retrieving, altering, and/or storing data structures into the computer system memory 410. Each element of the surface computer system 144 may be partially or completely network-based or cloud-based, and may or may not be located in a single physical location.

Exemplary embodiments of the processor 406 of the surface computer system 144 may include, but are not limited to, a digital signal processor (DSP), a central processing unit (CPU), a field programmable gate array (FPGA), a microprocessor, a multi-core processor, an application specific integrated circuit (ASIC), combinations, thereof, and/or the like, for example. The processor 406 may be capable of communicating with the computer system memory 410 via the path 414 (e.g., data bus). The processor 406 may be capable of communicating with the input device 402 and/or the output device 404.

The computer system memory 410 may store the software application 412 that, when executed by the processor 406 of the surface computer system 144, causes the surface computer system 144 to perform an action such as communicate with, or control, one or more component of the surface computer system 144, the drilling system 100 (e.g., the drill bit 114), and/or the mud pump 116.

In some embodiments, the computer system memory 410 of the surface computer system 144 may be located in the same physical location as the surface computer system 144, and/or one or more computer system memory 410 may be located remotely from the surface computer system 144. For example, the computer system memory 410 may be located remotely from the surface computer system 144 and communicate with the processor 406 via a communication channel. Additionally, when more than one computer system memory 410 is used, a first computer system memory may be located in the same physical location as the processor 406 of the surface computer system 144, and additional computer system memory may be located in a location physically remote from the processor 406 of the surface computer system 144. Additionally, the computer system memory 410 may be implemented as a "cloud" non-transitory processor-readable storage memory (i.e., one or more of the computer system memories 410 may be partially or completely based on or accessed using the communication channel).

In some embodiments, the computer system memory 410 of the surface computer system 144 may have a data store 411 that may store data such as network element version information, firmware version information, sensor data, system data, metrics, logs, tracing, and the like in a raw format as well as transformed data that may be used for tasks such as reporting, visualization, analytics, signal routing, power loading operations and/or coordination, etc. The data store 411 may include structured data from relational databases, semi-structured data, unstructured data, time-series data, and binary data. The data store 411 may be a database, a remote accessible storage, or a distributed filesystem. In some embodiments, the data store 411 may be a component of an enterprise network.

In one embodiment, the data store 411 may be one or more databases which may be one or more of a time-series database, a relational database or a non-relational database. Examples of such databases comprise, DB2®, Microsoft® Access, Microsoft® SQL Server, Oracle®, mySQL, PostgreSQL, MongoDB, Apache Cassandra, InfluxDB, Prometheus, Redis, Elasticsearch, TimescaleDB, and/or the like. It should be understood that these examples have been provided for the purposes of illustration only and should not be construed as limiting the presently disclosed inventive concepts. The database can be centralized or distributed across multiple systems.

The input device 402 of the surface computer system 144 may be capable of receiving information input from the user, another computer, and/or the processor 406, and transmitting such information to other components of the surface computer system 144 and/or the communication channel 34. The input device 402 may include, but is not limited to, embodiment as a keyboard, a touchscreen, a mouse, a trackball, a microphone, a camera, a fingerprint reader, an infrared port, a slide-out keyboard, a flip-out keyboard, a cell phone, a PDA, a remote control, a fax machine, a wearable communication device, a network interface, combinations thereof, and/or the like, for example.

The output device 404 of the surface computer system 144 may be capable of outputting information in a form perceivable by the user, another computer system, and/or the processor 406. For example, embodiments of the output device 404 may include, but are not limited to, a computer monitor, a screen, a touchscreen, a speaker, a website, a television set, a smart phone, a PDA, a cell phone, a fax machine, a printer, a laptop computer, a haptic feedback generator, a network interface, combinations thereof, and the like, for example. It is to be understood that in some exemplary embodiments, the input device 402 and the output device 404 may be implemented as a single device, such as, for example, a touchscreen of a computer, a tablet, or a smartphone. It is to be further understood that as used herein the term "user" is not limited to a human being, and may comprise a computer, a server, a website, a processor, a network interface, a user terminal, a virtual computer, combinations thereof, and/or the like, for example.

Returning to FIG. 1, the MWD tool 134 may provide data from the sensors 199 to the surface computer system 144. The data from the sensors 199 may be used for multiple purposes, such as determining an orientation of the drill bit 114, validating measurement values that determine an orientation/direction of the resulting borehole 101 while drilling wells such as oil wells, and, ultimately, allowing the operator to steer the drill bit 114 and the resulting borehole 101. In one embodiment, the MWD tool 134 may be programmed to take measurements with the one or more sensors 199 at predetermined time intervals and/or distance intervals.

For instance, in one embodiment, once a section of the borehole 101 substantially equal to a length of one drill pipe 105 in the drill string 108 has been drilled, workers may attach a new section of drill pipe 105 to drill string 108 while the MWD tool 134, which is situated in the borehole 101 close to the drill bit 114, may perform a survey in which the MWD tool 134 collects data with the sensors 199 regarding the formation properties and/or various drilling parameters. The collected data (which may be referred to as measurement values and/or downhole data) may be combined in the survey and transmitted to the surface 129 where the operator of the drilling system 100 uses the measurement values in the survey to plot out a desired trajectory of the borehole 101. The measurement values may be used to steer the drill bit 114 in the well along the desired trajectory.

In some embodiments, before drilling the next section of the borehole 101, drilling operations may be paused to allow the wireless telemetry module 132 of the MWD tool 134 time to transmit the data from the survey. During this transmission time, drilling may stop while the wireless telemetry module 132 transmits the survey. This amounts to "lost time due to surveying" and minimizing this lost time is a major point of emphasis for directional drilling companies and oil drilling companies. The surveys provide critical data that allow directional drilling operations to precisely and efficiently reach a desired location within the earth by controlling the trajectory of the borehole 101 throughout the drilling process. However, the amount of time needed for the wireless telemetry module 132 to transmit the surveys would be better spent actively drilling. The systems and processes disclosed herein solve this problem by greatly reducing the time required for transmitting surveys, and, thus, increase active time for drilling so that drilling resources and manpower are effectively used and the associated products from drilling (such as hydrocarbons) can begin to be extracted from the well sooner with more active drilling.

It should be noted that when drilling complex sections of the borehole 101, such as while the borehole 101 is being turned from the vertical direction (i.e., inclination of substantially) 0°, toward or to the horizontal direction (i.e., inclination of substantially) 90°, the drilling system 100 may be programmed to collect data (or survey) more often to ensure that the borehole 101 will finish the turn from the vertical direction to the horizontal direction at a desired depth in the earth and oriented along a desired azimuth, for instance.

Returning to FIG. 2, the MWD tool 134 may be configured to encode into binary digits (bits) one or more measurement values of the survey data using one or more encoding formats. The processor 210 of the MWD tool 134 may determine the particular encoding format to be used for a corresponding measurement value by comparing the measurement value to at least two ranges for that measurement value.

In some embodiments, encoding may comprise assigning a combination of bits to each of two or more measurement values in a range of measurement values. Encoding may comprise determining which combination of bits is assigned to a particular one of the measurement values in the range of measurement values. The format of a particular encoding for a range of measurement values may be referred to as an encoding format, which may be indicative of the unique combination of bits assigned to each discrete measurement value in the range, each unique combination of bits having an equal quantity of bits for that particular encoding format.

In some embodiments, the encoding format may include a numerical range and a compression level for that particular range. The compression level may define a number of bits necessary to encode the measurement value at a desired resolution for the range of the encoding format. The number of bits used in the compression level may be a reduction in a number of bits from a maximum number of bits required to transmit a particular measurement value if a full possible range at a set resolution for the measurement value is used.

The term "resolution" as used herein may refer to the level of precision of the numerical measurement value, for example, a difference between each of the discrete values in the range. That is, resolution may be defined by the size of the numerical gap between measurement values in the range.

A higher resolution measurement requires more bits for transmission of that measurement, since more bits are needed to describe a larger quantity of measurements in the range, and higher resolution may result in more possible measurement values in the range. However, increasing the number of bits means that the MWD tool 134 takes more time to transmit that larger number of bits containing the higher resolution measurement to the surface computer system 144.

For example, uncompressed, an inclination measurement value of an inclination angle downhole may have a full possible range of 0° to 180°. Typically, resolution of the inclination measurement value is one tenth of one degree. The range in the encoding format is a subset of the full possible range or, in some cases, the range in the encoding format may include the full possible range for the measurement value. The application 214 to be run by the processor 210 of the MWD tool 134 may define the number of bits used to encode the measurement data (that is, to be able to assign a unique combination of bits to each measurement value in the range of measurement values). Increasing the number of bits allows for a higher resolution measurement, but increasing the number of bits takes more time to transmit that larger number of bits containing the higher resolution measurement of the inclination measurement value from the MWD tool 134 to the surface computer system 144.

For example, if one bit were used to transmit a measurement value to the surface computer system 144, the MWD tool 134 could transmit only a 0 or a 1 in that one bit. For example, the value 0 could be assigned to correspond to 0° inclination and the value 1 could be assigned to correspond to 180° inclination. This level of resolution (that is, only two possible discrete measurement values in the range with a difference of 180 degrees between the lowest value and highest value in the range) may not be precise enough for steering the drill bit 114 accurately and precisely. Increasing the number of bits to two bits would double the transmission time of the inclination measurement value from the MWD tool 134 to the surface computer system 144, but would also increase the number of binary combinations (which may be referred to as unique combinations of bits) available to four (i.e., 00, 01, 10, and 11). For example, these four binary combinations may be assigned to correspond to 0°, 45°, 95°, and 135° of inclination, respectively.

Further increasing the number of bits results in $2^n$ combinations and a resolution equal to (Possible Range)/$2^n$. However, each additional bit results in a longer transmission time for the data.

Reducing the range from the full possible range of a measurement value to one or more lesser (smaller) predefined range within the full possible range allows for greater resolution, using the same number of bits or fewer bits as used for the full possible range, as will be described in more detail below. For example, if the inclination range is reduced from a full possible range of 0° to 180° to a first lesser range of 41° through 44°, then two bits would allow for one degree level of resolution for the measurement without increasing transmission time since additional bits are not needed. For example, binary combinations "00", "01", "10", and "11" may be assigned to correspond to 41°, 42°, 43°, and 44° of inclination, respectively.

Figure 4:
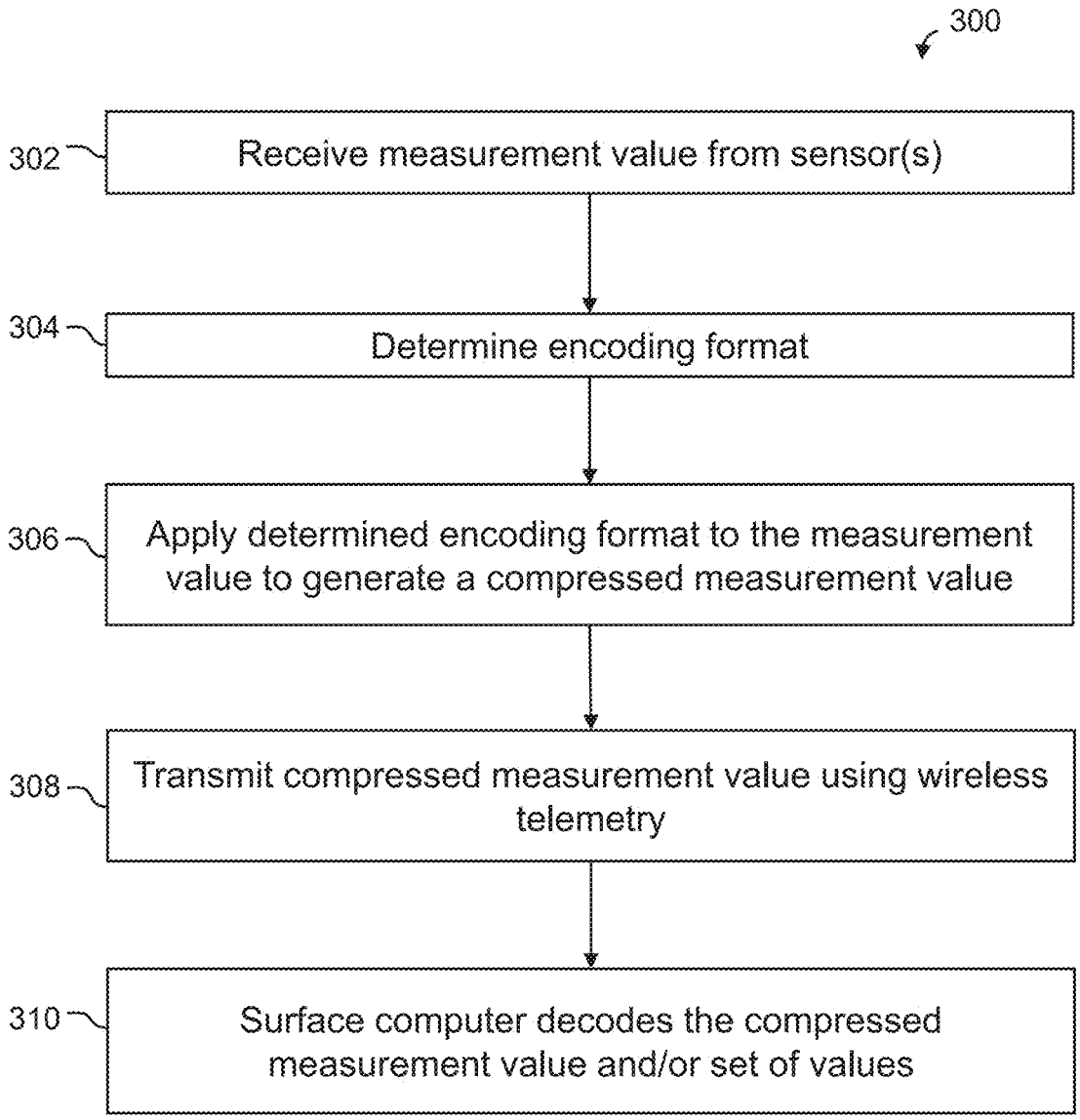
FIG. 4 is a process flow diagram of an exemplary survey optimization method in accordance with the present disclosure.

FIG. 4 illustrates an exemplary method 300 for the encoding and communication of survey data from the MWD tool 134 to the surface computer system 144. For the sake of illustration, the method 300 will be described using the drilling system 100. However, it should be noted that the method 300 may be used on any drilling system that transmits drilling data using LWD and/or MWD techniques.

In one embodiment, the method 300 may generally comprise the processor 210 of the MWD tool 134, in step 302, obtaining and/or receiving, using the one or more sensors 199 of the MWD tool 134 of the bottom-hole-assembly BHA 131 in a well, such as the borehole 101, a measurement value of a downhole parameter; in a step 304, determining, with the processor 210 of the MWD Tool 134, an encoding format having a compression level for the measurement value by comparing the measurement value to at least two predefined ranges, with each predefined range associated with a separate encoding format; in a step 306, applying, with the processor 210 of the MWD Tool 134, the determined encoding format to the measurement value to generate a compressed measurement value; in a step 308, transmitting, with the wireless telemetry module 132 of the bottom-hole-assembly 131 using wireless telemetry, the compressed measurement value; and in a step 310 decoding, with the processor 406 of the surface computer system 144 outside of the well, the compressed measurement value.

As previously discussed, the measurement value may be indicative of one or more types of downhole parameter, such as one or more of: inclination of the drill bit 114, the azimuth of the drill bit 114, a magnetic field strength at the current location of the drill bit 114, a gravitational field strength at the current location of the drill bit 114, and a dip angle of a formation at the current location of the drill bit 114. It will be understood that the measurement value may be or may include other measurements having to do with the orientation of the drill bit 114, the formation in which the drill bit 114 is located, a status of the drill bit 114, or other data or determined values. In some instances, the downhole parameter may be indicative of a position/orientation related to a planned position/orientation/direction of a drill bit of the bottom-hole-assembly 131. In some embodiments, the method 300 may be repeated for two or more of the different types of downhole parameters. For example, the method 300 may be repeated for each different type of downhole parameter in a survey. In some embodiments, one or more steps of the method 300 may be repeated for two or more measurement values.

The measurement value is within a full possible range for the measurement value, the full possible range having a first number of discrete values within the full possible range. The full possible range has a first resolution indicative of a difference in quantity between each of the discrete values within the full possible range, wherein a bigger difference results in a lesser resolution and wherein a smaller difference results in a greater resolution. The full possible range may be associated with a transmission length level based on a first number of bits needed to transmit the measurement value. The first number of bits may be indicative of how many bits are needed in order to assign a unique combination of bits to each of the first number of discrete values in the full possible range.

In step 304, the processor 210 of the MWD tool 134 may determine the encoding format having the compression level to be used for the measurement value by comparing the measurement value to at least two predefined ranges. Each predefined range may be associated with a separate encoding format. Each predefined range may have a corresponding second number of predefined discrete values defining the predefined range.

The compression level of each encoding format may be indicative of a corresponding second number of bits needed to transmit the measurement value. The second number of bits may be indicative of how many bits are needed in order to assign a unique combination of bits to each of the second number of predefined values defining the predefined range.

In some embodiments, the at least two predefined ranges include a first predefined range and a second predefined range. The first predefined range may be smaller than and within the second predefined range. In some embodiments, additional predefined ranges may be nested within one another. For example, in some embodiments, the at least two predefined ranges include the first predefined range, the second predefined range, and a third predefined range, wherein the first predefined range is smaller than and within the second predefined range, and wherein the second predefined range is smaller than and within the third predefined range. In some embodiments, a largest predefined range may be the full possible range for the measurement value.

For example, an inclination measurement value may have a full possible range of zero degrees to 180 degrees. The third predefined range for the inclination measurement value in this example may be a range of 78.3 degrees through 102.8 degrees, which is smaller than and within (encompassed by) the full predetermined range. The second predefined range inclination measurement value in this example may be a range of 83.7 degrees through 96.4 degrees, which is smaller than and within the first predetermined range. The first predetermined range for the inclination measurement value in this example may be a range of 86.9 degrees through 93.2 degrees, which is smaller than and within the second predetermined range and the third predetermined range. The predefined range chosen may be identified as and/or referred to as the "compression level" of the measurement value(s).

In some embodiments, the first predefined range may be smaller than and within the third predefined range, but not within the second predefined range, where the second predefined range is smaller than and within third predefined range.

Further, the predefined ranges may have a predefined resolution, where the predefined resolution is indicative of a difference between each of the discrete values in the range. In the example of inclination measurement values, for instance, the resolution may be one degree, for example. Or, the resolution may be one tenth of one degree, for example, or other desired resolution. In one example, the resolution may be described by the number of discrete values available within the range.

For example, in a first predefined range having a first resolution, there may be seven possible values within a first predefined range having a first difference of five degrees between each measurement value, such as 30 degrees, 35 degrees, 40 degrees, 45 degrees, 50 degrees, 55 degrees, and 60 degrees. In a second predefined range having a second resolution, there may be four possible values within the range having a difference of ten degrees between each measurement value, such as 30 degrees, 40 degrees, 50 degrees, and 60 degrees. In this example, the first resolution of the first predefined range has a higher resolution than the second resolution of the second predefined range, as the difference between the first measurement values of the first predefined range (5 degrees) is smaller than the difference between the second measurement values of the second predefined range (10 degrees).

Other resolutions may be used based on the desired precision of the measurement values that is helpful and/or necessary for the operator to make decisions from the measurement values, such as to orientate and/or guide the drill bit 114.

Determining the encoding format having the compression level for the measurement value may include comparing the measurement value to at least the first predefined range and the second predefined range (as well as any other predefined ranges), and choosing, as the determined encoding format for the measurement value, the encoding format associated with the smallest range of the first predefined range and the second predefined range in which the measurement value fits at the desired resolution.

Determining the encoding format having the compression level for the measurement value may include comparing the measurement value to a plurality of predefined ranges, and choosing as the determined encoding format for the measurement value the encoding format associated with the smallest range of the plurality of predefined ranges in which the measurement value fits.

In some embodiments, the plurality of predefined ranges may be nested ranges, where nested means that the smallest range of the plurality of predefined ranges is smaller than and fits within the second smallest range of the plurality of predefined ranges, the second smallest range of the plurality of predefined ranges is smaller than and fits within a third smallest range of the plurality of predefined ranges, the third smallest range of the plurality of predefined ranges is smaller than and fits within a fourth smallest range of the plurality of predefined ranges, and so on up to the largest of the plurality of predefined ranges, which is larger than and encompasses all of the other ones of the plurality of predefined ranges. In some embodiments, the largest predefined range may be the full range possible for the measurement value. Though first through fourth nested ranges are described for purposes of this example, it will be understood that nested ranges may include two or more ranges.

In some embodiments, the second number of predefined discrete values of each of the one or more predefined ranges has a corresponding second resolution indicative of a difference in quantity between each of the discrete values within the corresponding predefined range.

The first resolution of the full possible range may be less than the second resolution of one or more of the predefined ranges, such that the difference between each of the discrete values within the full possible range is greater than the difference between each of the discrete values within one or more of the predefined ranges.

The first resolution of the full possible range may be equal to the second resolution of one or more of the predefined ranges, such that the difference between each of the discrete values within the full possible range is the same as the difference between each of the discrete values within one or more of the predefined ranges.

The first resolution of the full possible range may be greater than the second resolution of one or more of the predefined ranges, such that the difference between each of the discrete values within the full possible range is less than the difference between each of the discrete values within one or more of the predefined ranges.

The step 304 of determining the encoding format may comprise choosing the encoding format associated with the predefined range with the smallest size into which the measurement value fits of the one or more predefined ranges, wherein the smallest size is based on a difference between a highest predefined value in the predefined range and a lowest predefined value in the predefined range.

In step 306, applying, with the processor 210 of the MWD Tool 134, the determined encoding format to the measurement value to generate a compressed measurement value may comprise transforming the measurement value into the unique combination of bits that represent the measurement value within the predetermined range of values of the encoding format using the corresponding combination of bits previously assigned. The measurement value as defined within the full possible range may have a first transmit length having a first number of bits, and the compressed measurement value as defined within the predefined range may have a second transmit length having a second number of bits less than the first number of bits, thereby reducing a time for transmitting the compressed measurement value.

Applying the determined encoding format to the measurement value may include encoding the measurement value into bits using a smaller number of bits than the number of bits required to transmit the measurement value in its original full possible range, by utilizing and encoding into bits a smaller range within the original full possible range.

In some embodiments, the processor 210 of the MWD Tool 134 may leave some measurement values uncompressed. For example, if one or more of the measurement values is compared to the predefined ranges and the processor 210 of the MWD Tool 134 determines that the measurement value is outside of all but the largest predefined range, or outside of all of the predefined ranges, the processor 210 of the MWD Tool 134 may not compress that measurement value.

In step 308, transmitting, with the wireless telemetry module 132 of the bottom-hole-assembly 131 using wireless telemetry, the compressed measurement value, may comprise modulating a flow resistance of drilling fluid within the drill string 108 to generate pressure pulses that propagate to the surface 129 at designated pulse widths. In an exemplary embodiment, the motor 240 of the wireless telemetry module 132 may actuate the valve 242 of the wireless telemetry module 132 to generate the pressure pulses.

In some embodiments, the method 300 may further comprise generating, with the processor 210 of the MWD tool 134, a decode key identifying a decoding format operable to decode the compressed measurement value; and transmitting the decoding key using the wireless telemetry to the processor 406 of the surface computer system 144 outside of the well. The decode key may comprise information regarding the range and/or ranges used for one or more measurement value and/or information regarding the resolution of the range and/or ranges. The decode key may comprise information regarding the combination of bits and the corresponding values assigned to each combination of bits.

In some embodiments, the step 310 of decoding, with the processor 406 of the surface computer system 144 outside of the well, the compressed measurement value may comprise utilizing the decoding format identified with the decode key transmitted from the processor 210 of the MWD tool via wireless telemetry through the wireless telemetry module 132 to interpret the transmitted compressed measurement value.

In some embodiments, transmitting the decode key occurs prior to and/or after transmitting the compressed measurement value.

In some embodiments, the method 300 may comprise the processor 406 of the surface computer system 144 outside of the well scanning a transmission from the processor 210 of the MWD tool 134 for a decode key. The processor 406 of the surface computer system 144 may detect the decode key.

The method 300 may comprise using the decoded measurement value to validate one or more measurement values, to monitor the drilling process, to compare an orientation of the drill bit 114 to a desired orientation, to compare a trajectory of the borehole to a planned trajectory, and/or to adjust the orientation and/or trajectory of the drill bit 114, that is, steer the drill bit 114 in the well, and thus adjust and/or maintain a trajectory of the borehole 101, for example.

In some embodiments, the method 300 may comprise decoding, with the processor 406 of the surface computer system 144 outside of the well, second compressed measurement values transmitted from the processor 210 of the MWD tool 134, utilizing the decoding format identified with a previously received first decode key.

In some embodiments, the method 300 may comprise identifying, with the processor 406 of the surface computer system 144 outside of the well, a second decode key in a second transmission from the processor 210 of the MWD tool 134. In some embodiments, the method 300 may comprise decoding, with the processor 406 of the surface computer system 144 outside of the well, third compressed measurement values transmitted from the processor 210 of the MWD tool 134, utilizing the decoding format identified with the second decode key.

In some embodiments, the processor 406 of the surface computer system 144 may detect a first decode key at a first instance of time and may detect a second decode key at a second instance of time after the first instance of time. The processor 406 of the surface computer system 144 may utilize the first decode key for decoding measurement values in transmissions received between the first instance of time and the second instance of time and may utilize the second decode key starting at the second instance of time. In some embodiments, the processor 406 of the surface computer system 144 may utilize the most recently received decode key to decode transmissions of measurement values.

The method 300 may be dynamic, in that the method 300 may be utilized at a plurality of instants of time. For example, the measurement value of the downhole parameter may be a first measurement value of a series of measurement values obtained from the one or more sensors 199 at a first time of distinct instances of time, and the method 300 may comprise obtaining, using the one or more sensors 199 in the bottom-hole-assembly 131, a second measurement value at a second time distinct from the first time; determining, with the processor 210 of the MWD tool 134, a second encoding format having a second compression level for the second measurement value by comparing the second measurement value to the at least two ranges, with each range associated with a separate encoding format; compressing, with the processor 210 of the MWD tool 134, the second measurement value to generate a second compressed measurement value using the second compression level associated with the second encoding format; generating, with the processor 210 of the MWD tool 134, a second decode key based on the second encoding format; transmitting, with the wireless telemetry module 132 of the bottom-hole-assembly 131 using wireless telemetry, the second decode key and the second compressed measurement value; and decoding, with the processor 406 of the surface computer system 144 outside of the well, the second compressed measurement value using the second decode key.

The method 300 may comprise using the decoded second measurement values to validate one or more measurement values, to monitor the drilling process, to compare an orientation of the drill bit 114 to a desired orientation, to compare a trajectory of the borehole to a planned trajectory, and/or to adjust the orientation and/or the trajectory of the drill bit 114, that is, steer the drill bit 114 in the well, and thus adjust and/or maintain a trajectory of the borehole 101, for example.

Figure 5:
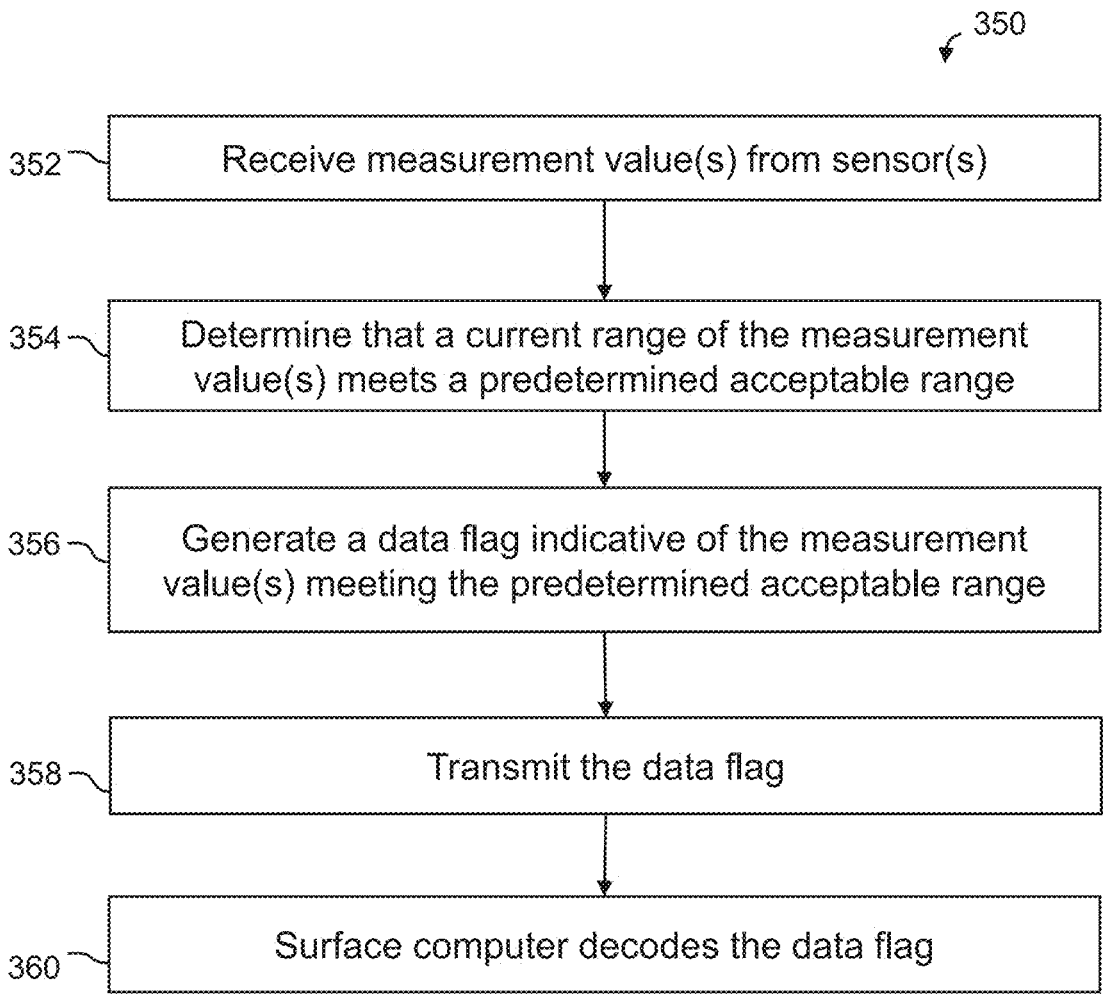
FIG. 5 is a process flow diagram of an exemplary method in accordance with the present disclosure.

As shown in FIG. 5, in some embodiments, a flagging method 350 may be used, either alone, or in conjunction with any or all of the other methods described herein. In some embodiments, one or more of the Compression Levels for one or more variables are designated as flags, so that when the Decode Key indicates that the Compression Level being used as a flag was used for that transmission, no further data transmission is needed.

In some embodiments, certain compression levels can be designated as representing an "acceptable range" rather than transmitting a specific quantitative value. In other words, when a variable's measured value falls within a predefined acceptable range, the with the processor 210 of the MWD tool 134 assigns a compression level that corresponds to that range. In this scenario, no actual measurement data needs to be sent to the surface computer system 144 beyond the decode key itself. The decode key, when it indicates that this particular compression level is in use, effectively signals to the surface computer system 144 that the variable is within the predefined acceptable range. As a result, the surface computer system 144 does not need to receive a separate numeric value, thus optimizing transmission efficiency while ensuring that the surface software application 412 of the surface computer system 144 can still interpret the data accurately.

The flagging method 350 may include, generally, associating one or more of the measurement values with a flag (which may be referred to as "flagged" or "flagging") indicative of the measurement value meeting a predetermined acceptable range. The flagging method 350 may comprise, in a step 352, obtaining using, and/or receiving from, the one or more sensors 199 in the measurement-while-drilling (MWD) tool 134 of the bottom-hole-assembly 131 in a well, one or more measurement values; a step 354 of determining, with the processor 210 of the MWD tool 134, that a current range of the one or more measurement values meets a predetermined acceptable range; and a step 356 of generating, with the processor 210 of the MWD tool 134, a data flag indicative of the one or more measurement values meeting the predetermined acceptable range.

The flagging method 350 may further comprise a step 358 of transmitting, with the wireless telemetry module 132 of the bottom-hole-assembly 131 using wireless telemetry, the data flag; and a step 360 of decoding, with the processor 406 of the surface computer system 144 outside of the well, the data flag, thereby determining that the current range of the measurement values meets the predetermined acceptable range, without receiving the one or more "flagged" measurement values from the processor 210 of the MWD tool 134.

In some embodiments, the data flag may be one bit in size, thereby greatly reducing the time needed to transmit the data flag indicative of the measurement value, as compared to time needed to transmit the full measurement value.

Like with the other measurement values, the processor 406 of the surface computer system 144 may utilize the determined flagged measurement value (that is, the decoded measurement value), based on the decoded data flag, to validate accuracy of a set of measurements, to monitor the drilling process, to compare an orientation of the drill bit 114 to a desired orientation, to compare a trajectory of the borehole to a planned trajectory, and/or adjust the orientation and/or the trajectory of the drill bit 114, that is, steer the drill bit 114 in the well, and thus adjust and/or maintain a trajectory of the borehole 101, for example.

In some embodiments, one or more measurement values such as one or more of Mag Field, Gravity, and Dip Angle, may be flagged, and may be used to validate the accuracy of other ones of the measurement values. The Mag Field, Gravity, and Dip Angle measurement values may be referred to as "qualifiers." For example, when inclination measurement values and/or azimuth measurement values are transmitted from the MWD tool 134, there may be a question of if those measurement values are accurate, or if they are inaccurate (for example, whether or not one or more of the one or more sensors 199 is broken or otherwise working incorrectly and provided an erroneous reading). To validate the measurement values, the drilling system 100 may transmit one or more of the qualifiers (such as one or more of Mag Field, Dip Angle, and Gravity measurement values).

For example, Earth's gravitational field is a known value of exactly one gee. So, if the measurement tool 134 uses gravitational sensors of the one or more sensors 199 to calculate a gravity of one gee and transmits a measurement value of one gee for the Gravity measurement value to the surface computer system 144, then the surface computer system 144 may determine that those gravitational sensors 199 are working correctly. Then, when the surface computer system 144 receives an Inclination measurement value based solely off of those same gravitational sensors 199, the surface computer system 144 has validated the Inclination measurement value, since the gravity measurement value from the same gravitational sensors 199 was correct. The Mag Field and Dip Angle measurement values may work analogously for the magnetic sensors (Mag Field) and both the magnetic and gravitational sensors again (Dip Angle).

In some embodiments, optionally, the one or more measurement values may be one or more first measurement values and the flagging method 350 may further comprise obtaining, using the one or more sensors 199 in the MWD tool 134 of the bottom-hole-assembly 131 in the well, one or more second measurement values at a later instant of time than when the first measurement values were received in the step 352; determining, with the processor 210 of the MWD tool 134, that a second current range of the second measurement values is outside of the predetermined acceptable range; transmitting, with the wireless telemetry module 132 of the bottom-hole-assembly 131 using wireless telemetry, the one or more second measurement values to the processor 406 of the surface computer system 144 outside of the well.

In some embodiments, optionally, the one or more measurement values may be one or more first measurement values, and the method 350 may further comprise obtaining, using the one or more sensors 199 in the MWD tool 134 of the bottom-hole-assembly 131 in the well, one or more second measurement values at a later instant of time than when the first measurement values were received in the step 352; determining, with the processor 210 of the MWD tool 134, that a second current range of the second measurement values is outside of the predetermined acceptable range; determining, with the processor 210 of the MWD tool 134, an encoding format of the one or more second measurement values, the determined encoding format comprising a range and comprising a compression level designed to encode the one or more second measurement values at a required resolution; applying, with the processor 210 of the MWD tool 134, the determined encoding format to generate one or more compressed second measurement values; generating, with the processor 210 of the MWD tool 134, one or more decode keys based on the one or more encoding formats for the compressed second measurement values; transmitting, with the wireless telemetry module 132 of the bottom-hole-assembly 131 using wireless telemetry, the one or more decode keys and the one or more compressed second measurement values; and decoding, with the processor 406 of the surface computer system 144 outside of the well, the one or more compressed second measurement values using the one or more decode keys.

Figure 6:
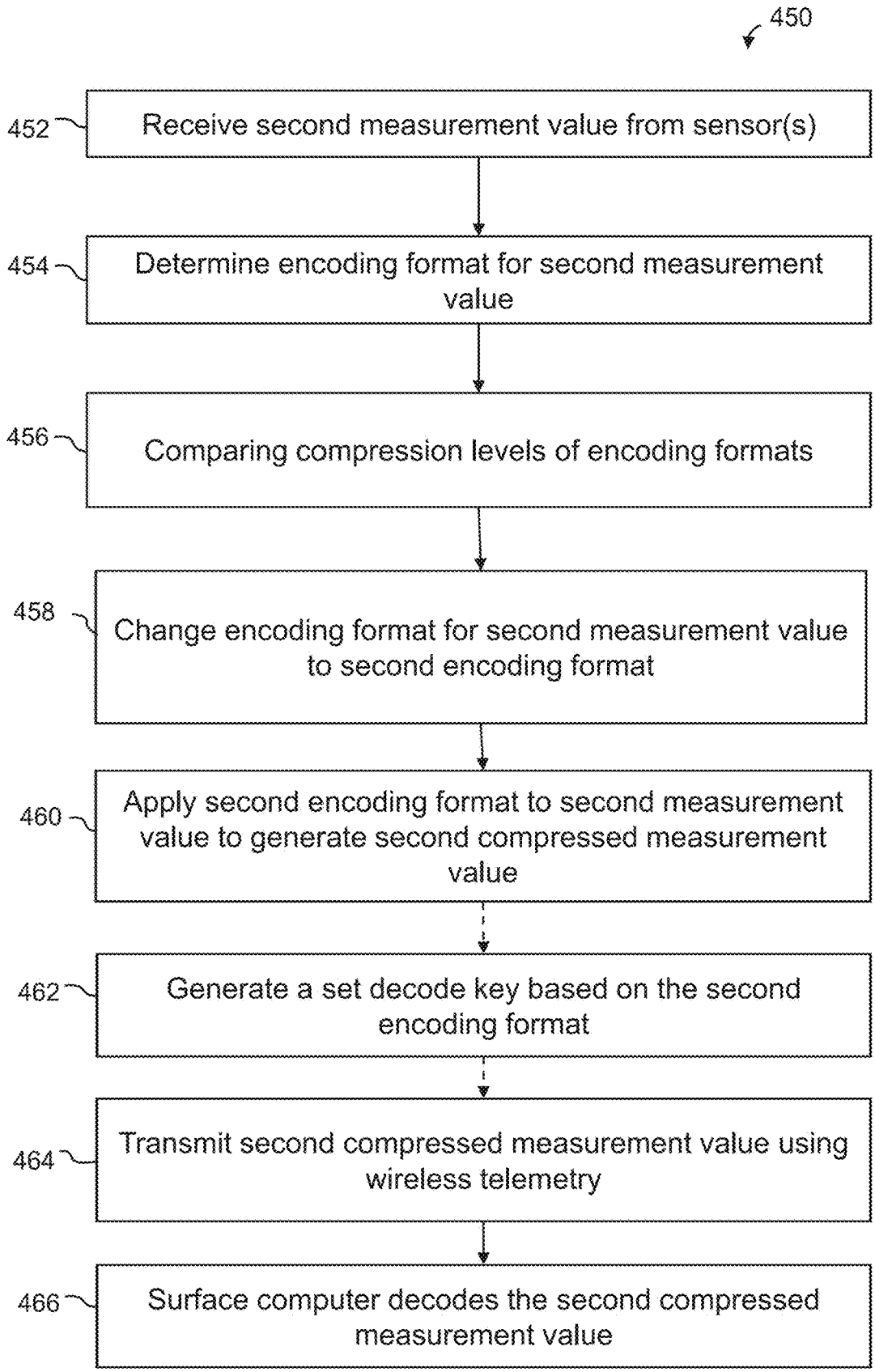
FIG. 6 is a process flow diagram of another exemplary method in accordance with the present disclosure.

As shown in FIG. 6, in some embodiments, a method 450 may be used in conjunction with the method 300 and/or in conjunction with other methods. The method 450 may generally comprise utilizing a shared compression level to transmit two or more measurement values (a set) fitting in different predefined ranges. The shared compression level for a set should be determined by the highest compression level that still allows each individual member's measurement to be included within its compression level's range. For example, if three measurement values fall within their Compression Level 1's range but one is outside of that but within its Compression Level 2's range, then the processor 210 of the MWD tool 134 utilizes Compression Level 2 for the set. Compression Level 1 (more compression) has tighter ranges and, if used for the set, then that one variable would be out of range. If Compression Level 2 is utilized, then all values can be represented. Typically, the number of bits does not factor into this decision, it is simply what is required to achieve the necessary resolution once the compression level, and thus the range, has been set.

More specifically, the method 450 may comprise a step 452 of obtaining, using the one or more sensors 199 in the measurement-while-drilling (MWD) tool 134 of the bottom-hole-assembly 131 in the well, a second measurement value. The step 452 may comprise receiving the second measurement value. The second measurement value may be part of a set of measurement values. In some embodiments, the set of measurement values may be part of, or all of, a survey.

The method 450 may comprise a step 454 of determining, with the processor 210 of the MWD tool 134, an encoding format having a compression level for the second measurement value by comparing the second measurement value to one or more predefined ranges within a full possible range for the second measurement value, with each predefined range associated with a separate encoding format. The compression level of each encoding format for the second measurement value is indicative of the predefined range within the full possible range.

The compression level of each encoding format for the second measurement value may be indicative of a corresponding third number of bits needed to transmit the second measurement value, wherein for each compression level the third number of bits is indicative of a minimum number of bits needed in order to assign a unique combination of bits to each of a third number of predefined values defining the predefined range for that compression level.

The method 450 may include a step 456 of comparing, with the processor 210 of the MWD tool 134, the compression level of the determined encoding format level for the second measurement value to the compression level of the first measurement value by comparing the predefined range (needed to transmit the first measurement value) to the predefined range needed to transmit the second measurement value.

The method 450 may include comparing, with the processor 210 of the MWD tool 134, the compression level of the determined encoding format level for the second measurement value to the compression level of the first measurement value by comparing the second number of bits (needed to transmit the compressed first measurement value) to the third number of bits needed to transmit the second measurement value.

The method 450 may include a step 458 of changing the determined encoding format for the second measurement value to a second encoding format for the second measurement value having a different compression level. In some embodiments, the third number of bits equals the second number of bits. The method 450 may include a step 460 of applying the second encoding format to the second measurement value to generate a second compressed measurement value; and step 464 of transmitting, with the wireless telemetry module 132 of the MWD tool 134 using wireless telemetry, the second compressed measurement value.

The method 450 may include a step 466 of decoding the second compressed measurement value with the surface computer system 144.

Optionally, the method 450 may include a step 462 of generating a set decode key based on the second encoding format; however, in some cases a previously generated set decode key may be used to decode the second compressed measurement value by the surface computer system 144. The set decode key may comprise information regarding the range and/or ranges used for one or more measurement value and/or information regarding the resolution of the range and/or ranges. The set decode key may comprise information regarding the combination of bits and the corresponding values to each combination of bits.

In some embodiments, the compression level may be indicative of an amount of reduction in the number of bits to be transmitted to communicate the measurement value from the processor 210 of the MWD tool 134 to the processor 406 of the surface computer system 144 outside of the well, based on a reduction in the range for the measurement value as compared to a full possible range of the measurement value.

As a hypothetical example, for a measurement value indicative of inclination of the drill bit 114, an uncompressed measurement value indicative of the inclination in a full predetermined range of zero degrees to 180 degrees may require a first number of bits (in this example, 11-bits) of encoding for transmission. A first compression level may be associated with a first predetermined range (in this example 78.3 degrees through 102.8 degrees), that is smaller than and within (encompassed by) the full predetermined range and that has a second number of bits (in this example, 8-bits) of encoding for transmission, reflecting a reduction in the number of bits from the first number of bits (in this example, a reduction of 3-bits).

Further, a second compression level may be associated with a second predetermined range (in this example, 83.7 degrees through 96.4 degrees), that is smaller than and within the first predetermined range and that has a third number of bits (in this example, 7-bits) of encoding for transmission, reflecting a further reduction in the number of bits from the first number of bits and the second number of bits. A third compression level may be associated with a third predetermined range (in this example, 86.9 degrees through 93.2 degrees), that is smaller than and within the second predetermined range and that has a fourth number of bits (in this example, 6-bits) of encoding for transmission, reflecting an even further reduction in the number of bits from the first, second, and third number of bits.

For ease of reference, to summarize, in this example:

full predetermined range: zero degrees to 180 degrees (11 bits);

first compression level having a first predetermined range: 78.3 degrees through 102.8 degrees (8 bits);

second compression level having a second predetermined range: 83.7 degrees through 96.4 degrees (7 bits);

third compression level having a third predetermined range: 86.9 degrees through 93.2 degrees (6 bits).

In the above example, the first compression level is considered to be a lower compression level (that is, produces less compression) than the second compression level, as the first compression level reduces the number of bits (in comparison to the first number of bits) less than the second compression level reduces the number of bits. Likewise, the second compression level is a lower compression level (that is, produces less compression) than the third compression level, as the second compression level reduces the number of bits (in comparison to the first number of bits) less than the third compression level reduces the number of bits.

In an example where the measurement value is an inclination of 90 degrees, using the above exemplary predetermined ranges and associated compression levels, the step 454 of determining, with the processor 210 of the MWD tool 134, the encoding format may comprise determining the encoding format having the third predetermined range associated with the third compression level, as the smallest range in which the measurement value fits. In contrast, in an example where the measurement value is an inclination of 95 degrees, using the above exemplary predetermined ranges and associated compression levels, the step 454 of determining, with the processor 210 of the MWD tool 134, the encoding format may comprise determining the encoding format having the second predetermined range and the associated second compression level, as the smallest of the available ranges in which the measurement value fits.

The encoding formats, and the ranges and compression levels of the encoding formats, may be different for each type of measurement value. A type of measurement value may be defined as a measurement of a specific type of parameter. Nonexclusive examples of types of measurement values may include inclination, azimuth, gravitational field strength, magnetic field strength, temperature, pressure, gamma radiation, dip angle, and position.

A particular set of measurement values may include one or more types of measurement values. In the step 454, an encoding format may be determined for each measurement value in a set of measurement values, which may result in a plurality of different determined encoding formats. Further, as a result, the step 454 may result in determined encoding formats having different compression levels and/or different numbers of bits in the unique combination of bits assigned to the discrete values in the different predefined ranges. As explained above, the different compression levels may have higher or lower amounts of reduction in the number of bits from a full number of bits to transmit the measurement value, when compared to one another.

Therefore, the step 456 of comparing compression levels of encoding formats of two measurement values and changing the encoding format of one of the measurement values, with the processor 210 of the MWD tool 134, may be carried out in order to accommodate the measurement value that fits the widest predetermined range and therefore needs the greatest number of bits in its unique combination of bits for transmission (at a same resolution).

For example, suppose that a set of measurement values comprised a first measurement value, a second measurement value, a third measurement value, a fourth measurement value, and a fifth measurement value, and if each of the first, second, third, and fourth of the measurement values fit within the predetermined range associated with a compression level having the least number of bits for that particular measurement value (for example, the third compression level in the inclination example), which is the fastest to transmit since it has the least number of bits. However, in this example, the fifth measurement value did not fit in the first predetermined range, but fit in the second predetermined range associated with a second compression level requiring a greater number of bits in the unique combination of bits assigned to the discreet values in the second predetermined range, then the encoding format having the second compression level would be chosen, such that the third number of bits equals the second number of bits. Then all of the first, second, third, fourth, and fifth measurement values would use the second compression level.

The method 450 may further comprise the step 460 of applying, with the processor 210 of the MWD tool 134, the second encoding format to the measurement value to generate a second compressed measurement value. Continuing with the above example, all of the first, second, third, fourth, and fifth measurement values in the set of measurement values would be encoded using the second compression level, since at least one of the measurement values (here, the fifth measurement value) requires for transmission the number of bits associated with the second compression level (that is, at least one of the measurement values falls within a range requiring that number of bits for transmission).

The method 450 may comprise utilizing one or more of the decoded measurement values to carry out one or more of: to steer the drill bit 114 in the well, to compare an orientation of the drill bit 114 to a desired orientation, to monitor the drilling process, to compare a trajectory of the borehole 101 to a planned trajectory, and/or adjust the orientation and/or the trajectory of the drill bit 114; and thus, to adjust and/or maintain a trajectory of the borehole 101, for example.

Figure 7:
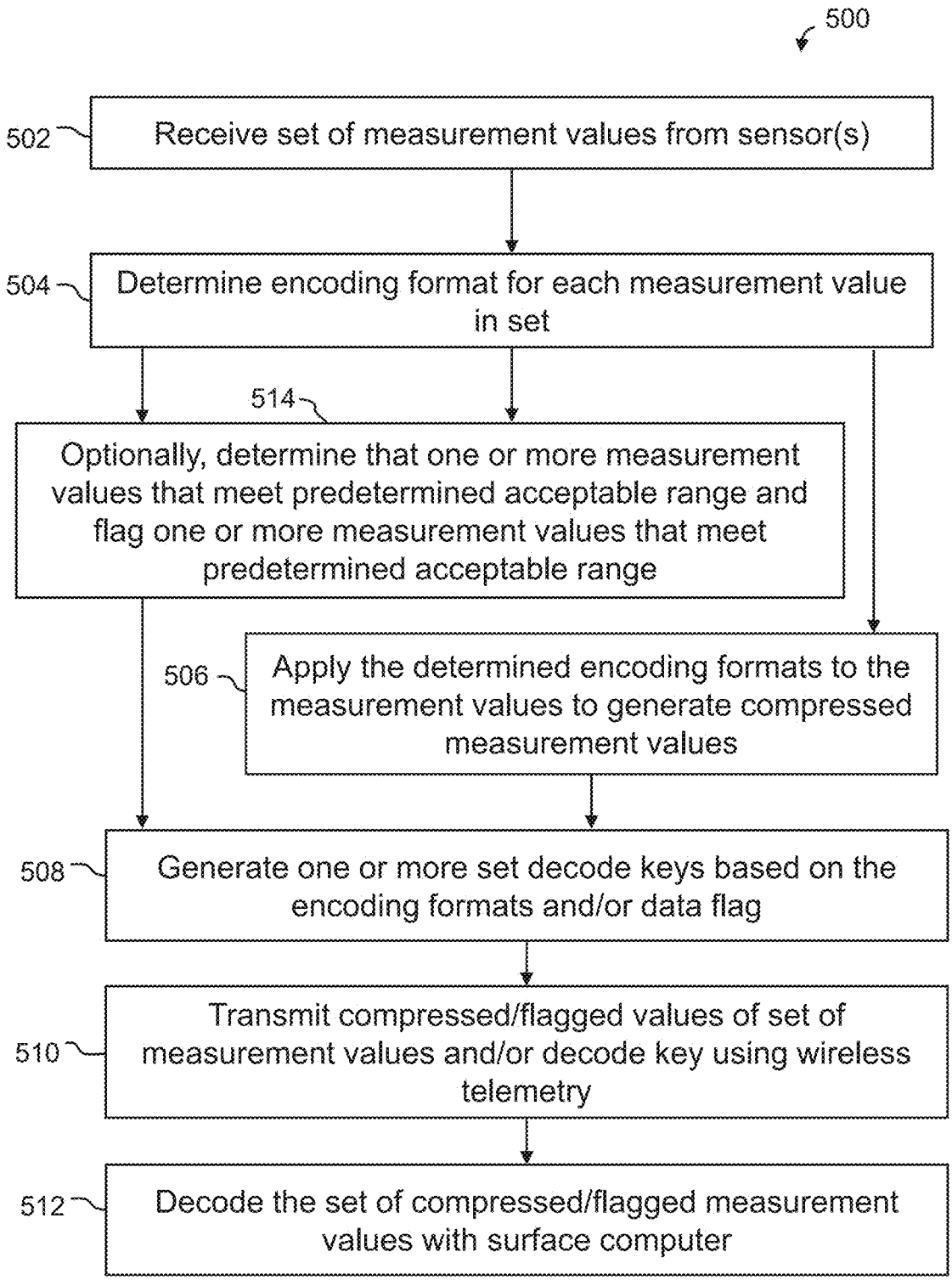
FIG. 7 is a process flow diagram of yet another exemplary method in accordance with the present disclosure.

As shown in FIG. 7, in some embodiments a method 500 may generally comprise utilizing one or more different compression levels for different measurement values in a set of measurement values. The method 500 may comprise a step 502 of obtaining, using the one or more sensors 199 in the measurement-while-drilling (MWD) tool 134 of the bottom-hole-assembly 131 in a well, a set of measurement values (and/or receiving the set of measurement values); a step 504 of determining, with the processor 210 of the MWD tool 134, an encoding format of each measurement value of the set of measurement values, each of the determined encoding formats comprising a range and comprising a compression level designed to encode the corresponding measurement value at a required resolution; and a step 506 of applying, with the processor 210 of the MWD tool 134, the corresponding determined encoding format for each of the measurement values of the set of measurement values using the corresponding compression level for that measurement value, to generate a compressed measurement value for each of the measurement values.

The method 500 may comprise a step 508 of generating, with the processor 210 of the MWD tool 134, one or more set decode keys based on the encoding formats. The one or more set decode keys may include all of the encoding formats for all of the measurement values of the set of measurement values. In some embodiments, a single set decode key may be generated to inform the surface computer system 144 of a plurality of the encoding formats used to encode a plurality of the measurement values in the set of measurement values. In some embodiments, a single set decode key may be generated to inform the surface computer system 144 of all of the encoding formats used to encode all of the measurement values in the set of measurement values. In some embodiments, two or more decode keys may be generated to identify encoding formats used to encode the one or more of the measurement values in the set of measurement values.

The method may comprise a step 510 of transmitting, with the wireless telemetry module 132 of the bottom-hole-assembly 131 using wireless telemetry, the set decode key (or set decode keys) and the compressed measurement values. The set decode key(s) may be sent in conjunction with or separately from (before or after) the compressed measurement values. In some embodiments, the set decode keys may comprise two or more decode keys including a first decode key and a second decode key, wherein the first decode key is indicative of the compression level and range of a first compressed measurement value of the compressed measurement values and wherein the second decode key is indicative of the compression level and range of a second compressed measurement value of the compressed measurement values.

The method may comprise a step 512 of decoding, with the processor 406 of the surface computer system 144 outside of the well, the compressed measurement values using the set decode key(s).

Optionally, the method 500 may further comprise a step 514 of determining, with the processor 210 of the MWD tool 134, that the range of at least one of the measurement values of the set of measurement values meets a predetermined acceptable range; and flagging, with the processor 210 of the MWD tool 134, one or more measurement values of the set of measurement values with the range that meets the predetermined acceptable range, with one or more data flags, as describe previously.

The method 500 may comprise utilizing one or more of the decoded measurement values and the interpreted one or more data flags to carry out one or more of: to validate one or more of the measurement values, to steer the drill bit 114 in the well, to monitor the drilling process, to compare an orientation of the drill bit 114 to a desired orientation, to compare a trajectory of the borehole 101 to a planned trajectory, and/or adjust the orientation and/or the trajectory of the drill bit 114; and thus, to adjust and/or maintain a trajectory of the borehole 101, for example.

Figure 8:
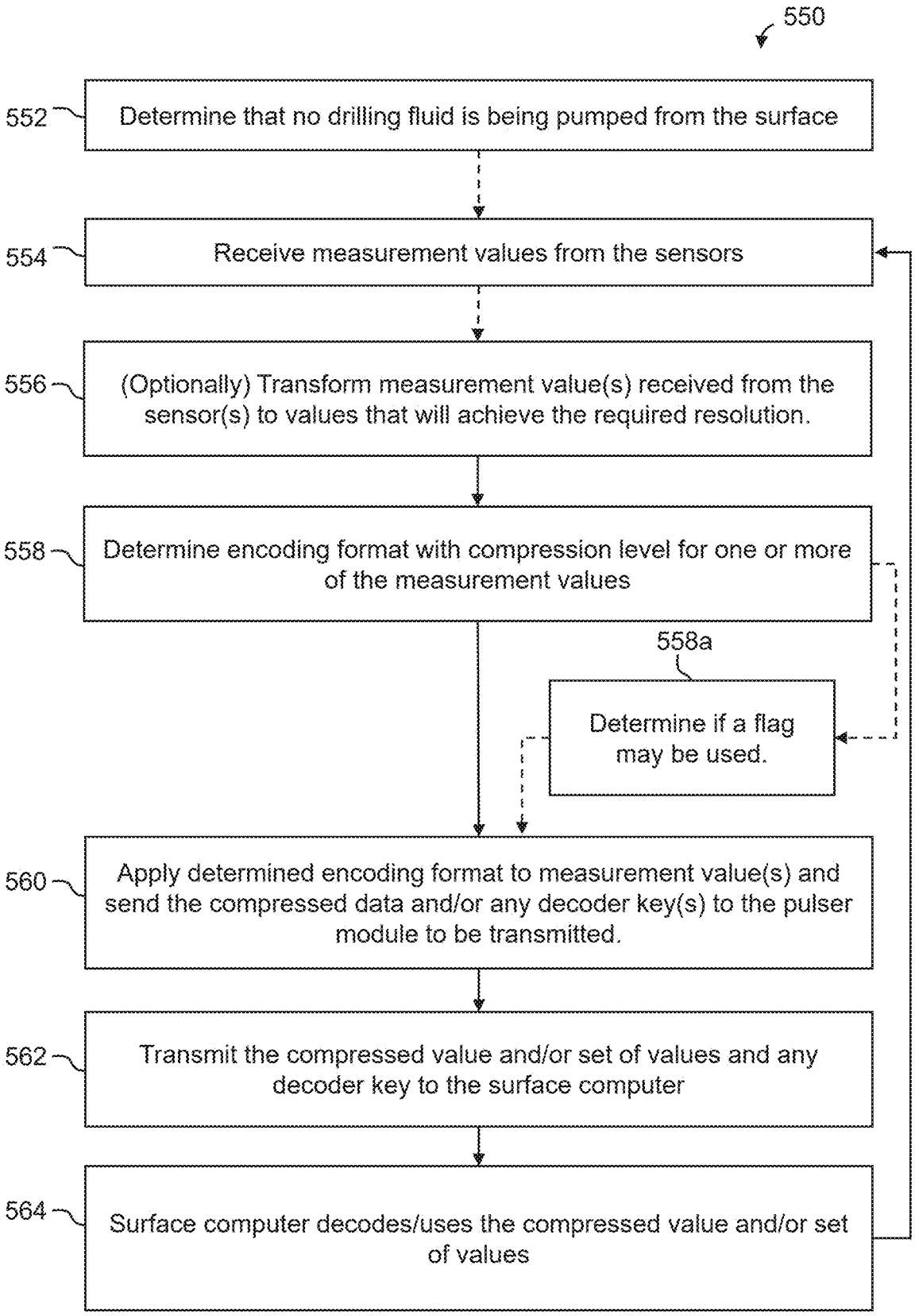
FIG. 8 is a process flow diagram of yet another exemplary method in accordance with the present disclosure.

Shown in FIG. 8 is an example of one embodiment of a survey optimization method 550 in hypothetical use to achieve directional drilling with a desired precision and accuracy, while significantly reducing transmission time. For the sake of illustration, the survey optimization method 550 will be described using the drilling system 100. However, it should be noted that the survey optimization method 550 may be used on any drilling system that transmits drilling data using LWD and/or MWD techniques.

In a step 552, optionally, the MWD tool 134, configured to monitor a flow state of the drilling fluid being pumped from the surface 129, may determine that no drilling fluid is being pumped from the surface 129. In some embodiments, the MWD tool 134 may wait a predetermined amount of time and then may obtain readings from the one or more sensors 199 (such as the one or more gyroscopes 200, the one or more magnetometers 202, and/or the one or more accelerometers 204). In an exemplary embodiment, the predetermined amount of time is a time between twenty seconds and sixty seconds, though it will be understood that other amounts of time may be used. In some embodiments, the MWD tool 134 may trigger the one or more sensors 199 to obtain the readings.

In a step 554, the MWD tool 134 may receive and/or obtain measurement values (also known as surveys) from the one or more sensors 199, such as the one or more gyroscopes 200, the one or more magnetometers 202, and/or the one or more accelerometers 204.

In some embodiments, the measurement values may be stored in a table or database in the memory 212 of the MWD tool 134.

Exemplary data that will be used for the describing examples of the survey optimization method 550 is illustrated in tables 1.1-1.4 below. The exemplary data illustrated in tables 1.1-1.4 was obtained by taking actual telemetry data from a well that was previously drilled and applying the compression methods described herein to determine compression levels, and thus time savings, that could be achieved for each survey cycle individually, as well as the complete well overall.

TABLE 1.1

| | | SURVEYS RECORDED BY TOOL | | | | | Well |
|---|---|---|---|---|---|---|---|
| Survey | Time | Inc | Azm | DipA | MagF | Grav | Section |
| 1 | 17:02:21 | 5.06 | 135.66 | 58.9 | 0.468 | 1.000 | Vertical |
| 2 | 17:24:33 | 4.66 | 134.95 | 58.9 | 0.468 | 1.000 | Vertical |
| 3 | 17:46:6 | 7.34 | 137.59 | 57.96 | 0.466 | 1.000 | Vertical |
| 4 | 18:5:19 | 10.51 | 136.27 | 58.00 | 0.465 | 1.000 | Vertical |
| 5 | 18:21:55 | 10.90 | 133.02 | 58.00 | 0.465 | 1.000 | Vertical |
| 6 | 18:36:01 | 10.64 | 132.67 | 57.96 | 0.465 | 1.000 | Vertical |
| 7 | 18:54:29 | 9.71 | 132.58 | 57.91 | 0.465 | 1.000 | Vertical |
| 8 | 19:8:43 | 9.01 | 133.72 | 57.96 | 0.465 | 1.000 | Vertical |
| 9 | 19:22:31 | 7.96 | 133.90 | 57.91 | 0.466 | 1.000 | Vertical |
| 10 | 19:37:10 | 7.12 | 133.90 | 57.91 | 0.465 | 1.000 | Vertical |
| 61 | 7:45:23 | 3.91 | 320.84 | 57.25 | 0.462 | 1.000 | Curve |
| 62 | 9:52:47 | 9.58 | 326.47 | 57.21 | 0.462 | 1.000 | Curve |
| 63 | 10:57:48 | 17.80 | 326.38 | 56.90 | 0.462 | 1.000 | Curve |
| 64 | 12:30:28 | 25.32 | 326.82 | 56.77 | 0.462 | 1.000 | Curve |
| 65 | 14:31:15 | 33.19 | 326.64 | 56.59 | 0.462 | 0.999 | Curve |
| 76 | 4:15:38 | 91.87 | 324.27 | 55.89 | 0.456 | 1.000 | Lateral |
| 77 | 5:18:53 | 94.37 | 324.53 | 55.80 | 0.455 | 1.000 | Lateral |
| 78 | 6:14:35 | 93.19 | 323.57 | 55.93 | 0.455 | 1.000 | Lateral |
| 79 | 6:44:20 | 92.26 | 321.90 | 55.85 | 0.455 | 1.000 | Lateral |
| 80 | 7:28:36 | 91.78 | 323.92 | 55.89 | 0.455 | 0.999 | Lateral |
| 81 | 7:53:17 | 91.82 | 323.83 | 55.89 | 0.455 | 1.000 | Lateral |
| 82 | 8:16:8 | 90.81 | 318.12 | 55.98 | 0.455 | 0.999 | Lateral |
| 83 | 9:22:15 | 90.90 | 315.4 | 55.89 | 0.455 | 1.000 | Lateral |
| 84 | 10:18:27 | 92.22 | 318.56 | 55.93 | 0.455 | 0.999 | Lateral |
| 85 | 10:58:03 | 92.48 | 319.96 | 55.85 | 0.454 | 1.000 | Lateral |

In an optional step 556, the processor 210 of the MWD tool 134 may be programmed and/or execute instructions to transform the data received from the sensors 199 into values that will achieve a required precision. For example, in the illustrated embodiment, the received values may be rounded to a nearest number that achieves the required precision.

Using inclination as an example, the most common required precision used is 0.1°. The inclination value associated with survey 1 in table 1.1 was originally 5.06°, but only a precision to a tenth of one degree is required, so the processor 210 transforms 5.06° to 5.1° by rounding to the nearest tenth. Transformed values are illustrated below in table 1.2.

TABLE 1.2

| | ROUNDED TO VALID VALUE | | | | |
|---|---|---|---|---|---|
| Survey | Inc. | Azm. | DipA | MagF | Grav |
| 1 | 5.1 | 135.7 | 58.55 | 0.469 | 1.000 |
| 2 | 4.7 | 135.0 | 58.55 | 0.469 | 1.000 |
| 3 | 7.3 | 137.6 | 57.55 | 0.467 | 1.000 |
| 4 | 10.5 | 136.3 | 57.55 | 0.465 | 1.000 |
| 5 | 10.9 | 133.0 | 57.55 | 0.465 | 1.000 |
| 6 | 10.6 | 132.7 | 57.55 | 0.465 | 1.000 |
| 7 | 9.7 | 132.6 | 57.55 | 0.465 | 1.000 |
| 8 | 9 | 133.7 | 57.55 | 0.465 | 1.000 |
| 9 | 8 | 133.9 | 57.55 | 0.467 | 1.000 |
| 10 | 7.1 | 133.9 | 57.55 | 0.465 | 1.000 |
| 61 | 3.9 | 320.8 | 57.55 | 0.463 | 1.000 |
| 62 | 9.6 | 326.5 | 57.55 | 0.463 | 1.000 |
| 63 | 17.8 | 326.4 | 56.55 | 0.463 | 1.000 |
| 64 | 25.3 | 326.8 | 56.55 | 0.463 | 1.000 |
| 65 | 33.2 | 326.6 | 56.55 | 0.463 | 0.998 |
| 76 | 91.9 | 324.3 | 55.55 | 0.457 | 1.000 |
| 77 | 94.4 | 324.5 | 55.55 | 0.455 | 1.000 |
| 78 | 93.2 | 323.6 | 55.55 | 0.455 | 1.000 |
| 79 | 92.3 | 321.9 | 55.55 | 0.455 | 1.000 |
| 80 | 91.8 | 323.9 | 55.55 | 0.455 | 0.998 |
| 81 | 91.8 | 323.8 | 55.55 | 0.455 | 1.000 |
| 82 | 90.8 | 318.1 | 55.55 | 0.455 | 0.998 |
| 83 | 90.9 | 315.0 | 55.55 | 0.455 | 1.000 |
| 84 | 92.2 | 318.6 | 55.55 | 0.455 | 0.998 |
| 85 | 92.5 | 320.0 | 55.55 | 0.455 | 1.000 |

It should be noted that the processor 210 of the MWD tool 134 may be programmed and/or execute instructions not to compress one or more of the measurement values in some situations. For instance, when drilling a vertical phase of a well, an operator may choose to not compress an azimuth value, for instance. In such an instance, the processor 210 of the MWD tool 134 may be programmed to not compress the azimuth value and send an uncompressed azimuth value for surveys 1-10 in the vertical phase. As drilling changes from the vertical phase to a horizontal phase, the MWD tool 134 may be programmed to begin compressing the azimuth value, starting by transforming the azimuth value (e.g., beginning at survey 76).

In step 558 of the survey optimization method 550, the one or more processors 210 of the MWD tool 134 may determine an encoding format having a compression level for each of the surveys (the surveys comprising one or more measurement values) and/or for each measurement value in a set of measurement values in the survey. For the purposes of illustration, determining a compression level of an inclination measurement value will be described in detail.

In accordance with one embodiment of the present disclosure, four encoding formats associated with four corresponding compression levels may be determined for each of the inclination measurement values. To determine the four compression levels for each inclination measurement value, the one or more processors 210 of the MWD tool 134 may be programmed to determine an expected value based on a phase of drilling operations as well as a required resolution (which may be input by a user in some embodiments). For example, during a vertical drilling phase, an expected value for inclination is 0° (or vertical). For purposes of illustration, the most common required inclination resolution of 0.1° will be used for this example.

It should be noted that in some embodiments of the survey optimization method 550, the measurement values may be transmitted from the processor 210 of the MWD tool 134 with one additional parity bit which may be used for data validation. The parity bits may be used by the processor 406 of the surface computer system 144 to determine if a transmitted value has been mis-decoded by the surface computer system 144. In some embodiments, aside from the parity bits, all other bits may be used to encode the measurement value itself.

Using the exemplary expected value of 0° in the vertical drilling phase, and using a 0.1° required resolution, compressing the inclination measurement value may reduce the size of the inclination measurement value transmission from 11 bits to 8 bits (that is, seven data bits plus one parity bit) in a compression level one. With a size of seven data bits, the MWD tool 134 has the ability to use up to $2^7$, (that is, 128), different unique binary combinations. That means at the 0.1° required resolution, every value between 0.0° and 12.7° using a gap of a tenth of a degree between values (the resolution) can be represented in the seven data bits. While drilling vertically, 12.7° may be considered a large range of angle of inclination in the borehole 101 and encompasses a majority of inclination values obtained while drilling in the vertical phase.

However, if the borehole 101 were to walk out (that is, vary from vertical more than expected), the inclination value still needs to be transmitted. To facilitate this eventuality, a compression level two may be provided having one more bit (eight data bits plus one parity bit), so the drilling system 100 can cover $2^8$, or 256, binary combinations using compression level two. Using the exemplary values, the MWD tool 134 is capable of transmitting any value between 0.0° and 25.5° using compression level two.

A compression level three adds another bit (nine data bits plus one parity bit), for 512 combinations (that is, $2^9$), giving compression level three a range of 0.0° to 51.1°.

In the unlikely event that 51.1° were exceeded—such as the rare case in which the drill bit 114 was programmed incorrectly and was not oriented vertically—then a compression level four, which does not represent any compression, could be used to transmit ten data bits plus one parity bit to cover all possible values between 0.0°-102.4° at the desired 0.1° resolution.

Using the survey optimization method 250, any value can be transmitted without sacrificing the desired resolution. The level of compression being used may be changed to encompass the desired resolution, and, therefore, the amount of time it takes to transmit the data changes from the processor 210 of the MWD tool 134 to the processor 406 of the surface computer system 144 with the level of compression. If the measurement value is close to the expected value, a higher compression may be used, and the transmission time is greatly reduced from a transmission time for the full, uncompressed, measurement value. If the measurement value is reasonably close to the expected value, some compression (less than the highest amount) may be used, and a moderate amount of time is saved in the transmission time. Finally, if the measured value is very different than what is expected, the full, uncompressed, measurement value may be transmitted using compression level four, which does not save transmission time, but ensures that the measured value is transmitted to be used by the drilling system 100.

Table 1.3 below illustrates exemplary compression levels based on the values in Table 1.2 and using exemplary encoding formats having associated measurement value ranges and compression levels.

In this example, the higher the compression level number, the larger the number of bits needed and the less reduction in transmission time in order to transmit the bits as compared to using a full possible range. However, it will be understood that the rubric may be that the lower the compression level number, the smaller the number of bits needed and a greater reduction in transmission time in order to transmit the bits as compared to using a full possible range, and that the example shown is for illustrative purposes.

TABLE 1.3

| Survey Number (i.e., set of measurement values number) | INDIVIDUAL COMPRESSION LEVEL Inc | Azm | DipA | MagF | Grav | Overall Compression Level |
|---|---|---|---|---|---|---|
| 1 | 1 | 0 | 2 | 2 | 1 | 2 |
| 2 | 1 | 0 | 2 | 2 | 1 | 2 |
| 3 | 1 | 0 | 1 | 1 | 1 | 1 |
| 4 | 1 | 0 | 1 | 1 | 1 | 1 |
| 5 | 1 | 0 | 1 | 1 | 1 | 1 |
| 6 | 1 | 0 | 1 | 1 | 1 | 1 |
| 7 | 1 | 0 | 1 | 1 | 1 | 1 |
| 8 | 1 | 0 | 1 | 1 | 1 | 1 |
| 9 | 1 | 0 | 1 | 1 | 1 | 1 |
| 10 | 1 | 0 | 1 | 1 | 1 | 1 |
| 61 | 0 | 0 | 1 | 1 | 1 | 1 |
| 62 | 0 | 0 | 1 | 1 | 1 | 1 |
| 63 | 0 | 0 | 1 | 1 | 1 | 1 |
| 64 | 0 | 0 | 1 | 1 | 1 | 1 |
| 65 | 0 | 0 | 1 | 1 | 1 | 1 |
| 76 | 1 | 1 | 1 | 1 | 1 | 1 |
| 77 | 1 | 1 | 1 | 1 | 1 | 1 |
| 78 | 1 | 1 | 1 | 1 | 1 | 1 |
| 79 | 1 | 1 | 1 | 1 | 1 | 1 |
| 80 | 1 | 1 | 1 | 1 | 1 | 1 |
| 81 | 1 | 1 | 1 | 1 | 1 | 1 |
| 82 | 1 | 1 | 1 | 1 | 1 | 1 |
| 83 | 1 | 1 | 1 | 1 | 1 | 1 |
| 84 | 1 | 1 | 1 | 1 | 1 | 1 |
| 85 | 1 | 1 | 1 | 1 | 1 | 1 |

For the example illustrated in Table 1.3, the lowest amount of compression (that is, the compression level that can encompass the largest required measurement value) of all of the compression levels in a set of measurement values (that is, a particular survey) may be used for the entire set of measurement values (that is, for that survey).

For example, in survey number 1 in Table 1.3, the inclination measurement value falls in a range that allows for compression level 1, the azimuth measurement value falls in a range that allows for compression level 0, the dip angle measurement value falls in a range that allows for compression level 2, the magnetic field measurement value falls in a range that allows for compression level 2, and the gravity field measurement value falls in a range that allows for compression level 1. Since a compression level of 2 is the least compression (that is, requires that largest number of bits), then in some embodiments, the compression level 2 may be used for all of the measurement values in the particular measurement value set, which here is the measurement values in survey number 1. In some embodiments, separate compression levels may be used for different measurement values in the same measurement value set (i.e., survey).

The compression levels may reduce the full possible range of each measurement value to one or more smaller ranges that may be used to encode the bits for transmission, and, consequently, reduce the number of bits required to transmit the measurement value, while maintaining (or reaching) the required resolution. For example, uncompressed, the inclination value has a full possible range of 0° through 180°. Consequently, 11 bits are required to transmit all possible values between 0° and 180° at a 0.1° resolution (that is, $2^{11}$ to give a possible 2048 unique combinations in order to assign a unique combination to each of the possible values). Using the exemplary compression levels one, two, three, and four, inclination value (5.1°) associated with survey 1 falls within the range of compression level one (values between 0.0° and 12.7°) and will be transmitted using compression level one which only requires 8 bits to transmit the full inclination value, as can be seen in Table 1.4 below (that is, $2^8$ to give a possible 256 unique combinations). Being able to transmit using 8 bits instead of 11 bits results in a significant time savings of 38% in comparison to the transmission of 11 bits.

As can be seen in Table 1.3, in some embodiments one or more of the values may not be compressed (represented by compression level 0 in Table 1.3) during drilling operations. For instance, in one embodiment during the vertical phase of drilling, the MWD tool 134 may be programmed to not compress the azimuth value (as seen in surveys 1-10). During the curve phase, the processor 210 of the MWD tool 134 may be programmed to not compress either of the inclination value or the azimuth value (as seen in surveys 61-65). During the horizontal (or lateral) phase (as seen in surveys 76-85), the processor 210 of the MWD tool 134 may be programmed to compress and/or flag all of the measurement values in the set as will be explained further in detail herein.

The following Table 1.4 illustrates the numbers of bits in unique combinations of bits that may be assigned to transmit each measurement value in each set of measurement values (that is, in each survey) utilizing the corresponding compression levels in Table 1.3.

TABLE 1.4

| | BITS TELEMETERED (WITH PARITY) | | | | | BITS | |
|---|---|---|---|---|---|---|---|
| Survey | Inc | Azm | DipA | MagF | Grav | Total | Prior-Art |
| 1 | 8 | 13 | 3 | 5 | 3 | 32 | 59 |
| 2 | 8 | 13 | 3 | 5 | 3 | 32 | 59 |
| 3 | 8 | 13 | 0 | 0 | 0 | 21 | 59 |
| 4 | 8 | 13 | 0 | 0 | 0 | 21 | 59 |
| 5 | 8 | 13 | 0 | 0 | 0 | 21 | 59 |
| 6 | 8 | 13 | 0 | 0 | 0 | 21 | 59 |
| 7 | 8 | 13 | 0 | 0 | 0 | 21 | 59 |
| 8 | 8 | 13 | 0 | 0 | 0 | 21 | 59 |
| 9 | 8 | 13 | 0 | 0 | 0 | 21 | 59 |
| 10 | 8 | 13 | 0 | 0 | 0 | 21 | 59 |
| 61 | 11 | 13 | 0 | 0 | 0 | 24 | 59 |
| 62 | 11 | 13 | 0 | 0 | 0 | 24 | 59 |
| 63 | 11 | 13 | 0 | 0 | 0 | 24 | 59 |
| 64 | 11 | 13 | 0 | 0 | 0 | 24 | 59 |
| 65 | 11 | 13 | 0 | 0 | 0 | 24 | 59 |
| 76 | 7 | 8 | 0 | 0 | 0 | 15 | 59 |
| 77 | 7 | 8 | 0 | 0 | 0 | 15 | 59 |
| 78 | 7 | 8 | 0 | 0 | 0 | 15 | 59 |
| 79 | 7 | 8 | 0 | 0 | 0 | 15 | 59 |
| 80 | 7 | 8 | 0 | 0 | 0 | 15 | 59 |
| 81 | 7 | 8 | 0 | 0 | 0 | 15 | 59 |
| 82 | 7 | 8 | 0 | 0 | 0 | 15 | 59 |
| 83 | 7 | 8 | 0 | 0 | 0 | 15 | 59 |
| 84 | 7 | 8 | 0 | 0 | 0 | 15 | 59 |
| 85 | 7 | 8 | 0 | 0 | 0 | 15 | 59 |

In one exemplary embodiment, each measurement value may have associated compression levels and number of bits in the unique combination of bits required to transmit the value at the given compression level similar to the Inclination example above. As part of step 558, each of the measurement values (five are shown for illustrative purposes) may be individually checked against respective corresponding ranges of encoding formats associated with compression levels to determine the appropriate encoding format. For example, as explained above, each measurement value may have a range associated with each encoding format. When the MWD tool 134 determines that a value falls within the range associated with an encoding format, then in step 560 the MWD tool 134 may be programmed to apply the encoding format with the associated compression level to the measurement value. As seen in Table 1.3 above, for survey 1 the MWD tool 134 may determine that the dip angle (DipA) value was outside a range associated with compression level one, but within a range associated with compression level two. As a result, the MWD tool 134 may determine that the DipA value for survey 1 should be transmitted using compression level two.

In some embodiments, once an individual compression level has been set for each measurement value, the set of measurement values may then be encoded at the compression level that accommodated the single measurement value with the widest range (that is, the smallest possible range into which the single measurement value fits, but with the largest difference between the highest value and lowest value in the range), such that the compressed measurement values have the same length unique combination of bits per value. A single compression level used for all of the values in the set of measurement values may be referred to as a set compression level. For example, if four of the values fit within their respective compression level one ranges, which is the fastest to transmit, but the fifth value needed the expanded range of compression level two (which requires more bits), then the processor 210 of the MWD tool 134 may determine that a set compression level of two may be used and all five values may be sent using compression level two. It should be noted that in the example illustrated in table 1.3, during the vertical drilling phase the MWD tool 134 is programmed not to compress the azimuth value. As a result, the MWD tool 134 may be programmed to only include the measurement values for inclination (Inc), dip angle (DipA), magnetic field (MagF), and gravitational field (Grav) in the set of measurement values, and not include the azimuth value.

By using this exemplary set compression level two for the exemplary set of values, the set compression level, or the fixed cost for the wireless telemetry module 132 to transmit an encoder key configured to cause the processor 406 of the surface computer system 144 to decode the set of values using compression level two, may be shared across all five values and only one decode key (which will be referred to herein as a set decode key) may be transmitted one time, such as at the beginning of the set of values.

In some embodiments, a single decode key may be generated and transmitted for one survey. In some embodiments, one decode key may be used for multiple surveys. In some embodiments, individual decode keys may be generated and transmitted, such as one decode key for each measurement value in a set of measurement values. In some embodiments, a plurality of decode keys containing a plurality of decode information may be generated and transmitted.

In an optional step 558*a* of the survey optimization method 550, the processor 210 of the MWD tool 134 may execute instructions and/or be configured to determine if one or more of the measurement values may be flagged. Flagging a measurement value may be indicative that the value falls within an acceptable range and, as a result, the full value is not required to be transmitted. In one embodiment, one bit may be transmitted for a flagged measurement value that indicates TRUE, meaning that the measurement value falls within the acceptable range. In some embodiments, if the measurement value is not flagged (such as the measurement value falling outside of the acceptable range), then the processor 210 of the MWD tool 134 may execute instructions and/or be configured to send the full measurement value (and/or at the corresponding compression level as described above), so the operator may make an informed decision regarding the drill bit 114 using the transmitted measurement value. Specific flags may be predetermined and shared between the processor 406 of the surface computer system 144 and the one or more computer processors 210 of the MWD tool 134.

In one example, flags for gravity measurement values may be predetermined to indicate that anything within five mg (0.005 g) of a target value of 1 g is good. So, in one embodiment of the survey optimization method 250, if a measured gravity value is between 0.995 and 1.005, the processor 210 of the MWD tool 134 may execute instructions and/or be configured to flag the gravity value and transmit one bit representing TRUE, indicating that the gravity value is within the acceptable range. For any gravity value not within 5 mg, the processor 210 of the MWD tool 134 may execute instructions and/or be configured to transmit one bit representing FALSE indicating that the gravity value is not withing the acceptable range.

In one example, compression level one for gravity measurement values may be set such that any value within five mg (0.005 g) of 1 g falls under compression level one, for example. In such an embodiment, when the MWD tool 134 determines that the compression level of the gravity value is compression level one, the MWD tool 134 may be programmed to only transmit a decode key via the wireless telemetry module 132 to the processor 406 of the surface computer system 144 indicating that the gravity value would be compressed at compression level one. The processor 406 of the surface computer system 144 may be programmed to determine that the gravity value fell within the acceptable range (or was flagged) by receiving the decode key indicating compression level one for the gravity measurement value. As a result, the processor 406 of the surface computer system 144 does not need to receive the gravity measurement value itself, so no bits need to be transferred other than the decode key.

In one example, compression level one for the gravity measurement value may be set such that any value within five mg (0.005 g) of 1 g falls under compression level one. In such an embodiment, when the processor 210 of the MWD tool 134 determines that the compression level of the gravity value is compression level one, and the compression level of all other values are also at or below compression level one (in other words, the set compression level is one or zero), the processor 210 of the MWD tool 134 may be programmed to transmit a set decode key indicating set compression level one via the wireless telemetry module 132 to the surface computer system 144 and not transmit any other bits related to the gravity measurement value. Upon receiving the set decode key, the surface computer system 144 may be programmed to determine that the gravity measurement value is within the acceptable range based on the set compression level one of the set decode key and not require or expect to receive any further bits related to the gravity measurement value.

While the gravity measurement value has been used as an example, it should be noted that any measurement value may be flagged and require less (or no) bits to transmit the measurement value. For instance, as can be seen in Table 1.4 above, for surveys 3-10, the telemetered bits for DipA, MagF, and Grav are all 0. In other words, each of the values for DipA, MagF, and Grav had been determined by the processor 210 of the MWD tool 134 to fall within the acceptable range and flagged during each of those survey cycles. Further, as shown in table 1.3, each of the other measurement values in the set have been determined to be at or below compression level one (zero for azimuth value). As a result, the processor 210 of the MWD tool 134 may be programmed to only transmit the set decode key indicating compression level one (excluding azimuth value which will not be compressed in this scenario) via the wireless telemetry module 132 to the processor 406 of the surface computer system 144, and the processor 406 of the surface computer system 144 may be programmed to determine that each of the DipA, MagF, and Grav measurement values are within the acceptable range based on the compression level one of the set decode key(s) and not require or expect to receive any further bits related to the DipA, MagF, and Grav measurement values. In this example, because flagging was used, only 21 bits were required to transmit the set of measurement values for each of the surveys 3-10 as compared to 59 bits that would be required without these methods. This results in a very significant 65% reduction in transmission time.

In step 560, the processor 210 of the MWD tool 134 may be programmed to apply the encoding format determined in step 558 to the measurement values and to send the compressed measurement value(s) and/or the decoder key to the wireless telemetry module 132 to be transmitted to the surface computer system 144.

In some embodiments, the processor 210 of the MWD tool 134 may be programmed to wait until the drilling system 100 begins to pump drilling fluid once again before sending the compressed value to the wireless telemetry module 132 to be transmitted. In some such embodiments, the processor 210 of the MWD tool 134 may further be programmed to wait a predetermined period of time after the drilling system 100 begins to pump drilling fluid again before sending the compressed measurement value to the wireless telemetry module 132 to be transmitted. In some embodiments, the predetermined period of time may be between thirty seconds and 120 seconds, though it will be understood that other amounts of time may be used.

In step 562, the wireless telemetry module 132 may transmit the compressed measurement value(s), measurement values, and/or decoder key(s) (collectively referred to as telemetry data) to the surface computer system 144. In some embodiments, the step 562 may be performed while the drilling system 100 is pumping drilling fluid downhole, but before the drilling system 100 starts cutting again, i.e., before the drilling system 110 starts the mud motor and/or begins turning the drill bit 114.

In some embodiments, the wireless telemetry module 132 may transmit the compressed measurement value, set of measurement values, and/or decoder key(s) while active drilling is occurring, i.e., while after the mud motor has started and/or the drill bit 114 is turning. It should be noted, however, that this is not common practice because "noise" is added that may corrupt the data being transmitted in which case the mud pump 116 would have to be cycled again to restart the process which would result in greater loss of time.

In a step 564, the surface computer system 144 may receive and decode the compressed measurement value and/or set of measurement values. The surface computer system 144 and/or operator of the drilling system 100 may use the decoded measurement values (or downhole data) to validate one or more measurement values, to monitor the drilling process, to compare an orientation of the drill bit 114 to a desired orientation, to compare a trajectory of the borehole 101 to a planned trajectory, and/or to adjust the orientation and/or the trajectory of the borehole 101. The downhole data may also be used, for example, to provide information about the condition of the drill bit 114 and/or drill string 108, provide records of geological formations penetrated by the borehole 101, aid in creation of performance statistics to identify possible improvements to the drilling process, and aid in risk analysis for future drilling.

In some embodiments, the survey optimization method 550 may automatically restart at step 552 when the MWD tool 134 determines that no drilling fluid is being pumped from the surface 129 through the drill string 108.

Applying the survey optimization method 550 to data from actual wells resulted in a 70% effective reduction of bits needed to transmit sets of measurement data during the drilling of a well.

In use, in some embodiments, Inclination and Azimuth measurement values may be used to determine the orientation, but may not be flagged in order to provide detailed data for those measurement values. In some embodiments, the qualifiers (e.g., Mag Field, Gravity, and Dip Angle measurement values) may be the measurement values to be flagged, and not used to determine the orientation, but rather used to validate the accuracy of the Inclination and/or Azimuth measurements values.

A directional well is planned out before it is drilled. The plan details out the exact path of the wellbore, for example including exactly how long it drills straight down, when it begins to curve horizontally, over how many feet that curve takes place, which direction (Azimuth-North, South, East, West) it will be pointing when they enter the lateral, and how long that lateral will be. Directional drilling companies then drill that well and attempt to get as close to the plan as possible. When operators drill that well in practice, the rig will drill an interval (approximately 30 to approximately 90 feet at a time) then stop and measure inclination and azimuth. Inclination and azimuth are then used to calculate the path of the wellbore over the previous interval just drilled. Then, if they are off the plan, the operator may make adjustments to bring the drillbore back to that planned path.

For example, if in the lateral is supposed to be drilling due east (90 degrees), but an Azimuth measurement value of 92 degrees is received by the surface computer system 144, then the operator may take action and may slide to the left to try to get back to 90 degrees. If in the curve the operator thought the last interval would get the wellbore 101 was supposed to go from 50 degrees inclination to 60 degrees but only made it to 58 degrees, the operator may slide more aggressively to try to make up that last ground and get back to planned. If in the vertical the operator is supposed to be drilling straight down (zero degrees inclination) for the wellbore 101 but drifted to two degrees inclination, the operator may decide to slide and steer the well back to zero degrees.

Measurement value types of Mag Field, Dip Angle, and Gravity may be utilized as qualifiers in some embodiments.

These measurement values may be dual purpose, that is, to verify the accuracy of the survey and to actually improve the accuracy of the survey by mathematically reducing magnetic interference. When using survey management, the operator may send the qualifier measurement value types to a survey management group that may use mathematical techniques to improve the accuracy of the measurements.

For example, if a Gravity measurement value is received that is two gees when it is supposed to be one gee (this is grossly out of spec), the operator may determine that one of the gravitational sensors is broken and thus the rig needs to trip out of the borehole 101 to replace the MWD tool 134.

As another example, if a Gravity measurement value is received that is 1.025 gees instead of 1.000 gee (slightly out of spec), the operator may opt to retake this survey as this could indicate the pipe was moving around a bit.

As another example, if a Magnetic Field measurement value is received that is 0.600 instead of 0.500 (moderately out of spec), the operator may suspect magnetic interference and initiate a four-point roll test to check for it.

An example of a method in use includes obtaining, using one or more sensors 199 of the measurement-while-drilling (MWD) tool 134 of a bottom-hole-assembly 131 in the wellbore 101, a measurement value of a downhole parameter, the measurement value being within a full possible range for the measurement value, the full possible range having a first number of discrete values within the full possible range and having a first resolution indicative of a difference in quantity between each of the discrete values within the full possible range, wherein a bigger difference results in a lesser resolution and wherein a smaller difference results in a greater resolution.

The full possible range may be associated with a transmission length level based on a full quantity of bits needed to transmit the measurement value in the full possible range, wherein the full quantity of bits is indicative of a minimum quantity of bits needed in a combination in order to assign a unique combination of bits to each of the first quantity of discrete values in the full possible range.

The method may include determining, with the processor 210 of the MWD tool 134, an encoding format having a compression level for the measurement value by: comparing the measurement value to one or more predefined ranges within the full possible range, with each predefined range associated with a separate encoding format, each predefined range defined by a corresponding compressed quantity of predefined discrete values, The compression level of each encoding format may be indicative of a corresponding compression quantity of bits needed to transmit the measurement value, wherein the compression quantity of bits is indicative of a minimum number of bits needed in order to assign a unique combination of bits to each of the compressed quantity of predefined discreet values defining the predefined range, wherein the compression quantity of bits is less than the full quantity of bits needed for to transmit the full possible range.

The compressed quantity of predefined discrete values of each of the one or more predefined ranges has a corresponding second resolution, wherein the second resolution is indicative of a difference in quantity between each of the discrete values within the corresponding predefined range. In some embodiments, the first resolution is lesser than the second resolution such that the difference between each of the discrete values within the full possible range is greater than the difference between each of the discrete values within the predefined ranges.

The method may include choosing, with the processor of the MWD Tool 134, the encoding format associated with the predefined range with the smallest size into which the measurement value fits of the one or more predefined ranges, wherein the smallest size is based on a difference between a highest predefined value in the predefined range and a lowest predefined value in the predefined range.

The method may include applying, with the processor of the MWD Tool 134, the determined encoding format to the measurement value to generate a compressed measurement value, wherein the compressed measurement value contains fewer bits than would be used to assign unique combinations of bits for a full possible range at the second resolution.

The method may include transmitting, with the wireless telemetry module 132 of the bottom-hole-assembly 131 using wireless telemetry, the compressed measurement value; and decoding, with the processor 406 of the surface computer system 144 outside of the wellbore 101, the compressed measurement value.

In one example in use, a method may comprise obtaining, using the one or more sensors 199 of the measurement-while-drilling (MWD) tool 134 of a bottom-hole-assembly 131 in the wellbore 101, a measurement value of a downhole parameter, the measurement value being within a full possible range for the measurement value, the full possible range having a full quantity of discrete values within the full possible range and having a first resolution indicative of a difference in quantity between each of the discrete values within the full possible range, wherein a bigger difference results in a lesser resolution and wherein a smaller difference results in a greater resolution.

The full possible range may be associated with a transmission length level based on a full quantity of bits needed to transmit the measurement value, wherein the full quantity of bits is indicative of a minimum quantity of bits needed in a combination in order to assign a unique combination of bits to each of the first number of discrete values in the full possible range.

The method may comprise determining, with the processor of the MWD tool 134, an encoding format having a compression level for the measurement value by comparing the measurement value to one or more predefined ranges within the full possible range, with each predefined range associated with a separate encoding format, each predefined range defined by a corresponding compressed quantity of predefined discrete values.

The compression level of each encoding format may be indicative of a corresponding compression quantity of bits needed to transmit the measurement value, wherein the compression quantity of bits is indicative of a minimum number of bits needed in order to assign a unique combination of bits to each of the compressed quantity of predefined values defining the predefined range, wherein the compression quantity of bits is less than the full quantity of bits associated with the full possible range.

The compressed quantity of predefined discrete values of each of the one or more predefined ranges has a corresponding second resolution, wherein the second resolution is indicative of a difference in quantity between each of the discrete values within the corresponding predefined range.

The method may comprise choosing the encoding format associated with the predefined range with the smallest size into which the measurement value fits of the one or more predefined ranges, wherein the smallest size is based on a difference between a highest predefined value in the predefined range and a lowest predefined value in the predefined range.

The method may comprise applying, with the processor of the MWD Tool 134, the determined encoding format to the measurement value to generate a compressed measurement value, wherein the compressed measurement value contains fewer bits than would be used to assign unique combinations of bits for a full possible range at the second resolution; transmitting, with a wireless telemetry module 132 of the bottom-hole-assembly 131 using wireless telemetry, the compressed measurement value; and decoding, with a processor 406 of the surface computer system 144 outside of the wellbore 101, the compressed measurement value.

In one example in use, a method may comprise obtaining, using the one or more sensors 199 of the measurement-while-drilling (MWD) tool 134 of the bottom-hole-assembly 131 in the wellbore 101, a measurement value of a downhole parameter, the measurement value being within a full possible range for the measurement value, the full possible range having a first number of discrete values within the full possible range and having a first resolution indicative of a difference in quantity between each of the discrete values within the full possible range, wherein a bigger difference results in a lesser resolution and wherein a smaller difference results in a greater resolution.

The full possible range may be associated with a transmission length level based on a full quantity of bits needed to transmit the measurement value, wherein the full quantity of bits is indicative of a minimum number of bits needed in a combination in order to assign a unique combination of bits to each of the first number of discrete values in the full possible range.

The method may comprise determining, with the processor 210 of the MWD tool 134, an encoding format having a compression level for the measurement value by: comparing the measurement value to one or more predefined ranges within the full possible range, with each predefined range associated with a separate encoding format, each predefined range defined by a corresponding compressed quantity of predefined discrete values.

The compression level of each encoding format may be indicative of a corresponding compression quantity of bits needed to transmit the measurement value, wherein the compression quantity of bits is indicative of a minimum number of bits needed in order to assign a unique combination of bits to each of the compressed quantity of predefined values defining the predefined range.

The compressed quantity of predefined discrete values of each of the one or more predefined ranges has a corresponding second resolution, wherein the second resolution is indicative of a difference in quantity between each of the discrete values within the corresponding predefined range. In some embodiments, the first resolution is less than the second resolution such that the difference between each of the discrete values within the full possible range is greater than the difference between each of the discrete values within the predefined ranges.

The method may comprise choosing the encoding format associated with the predefined range with the smallest size into which the measurement value fits of the one or more predefined ranges, wherein the smallest size is based on a difference between a highest predefined value in the predefined range and a lowest predefined value in the predefined range.

The method may comprise applying, with the processor of the MWD Tool, the determined encoding format to the measurement value to generate a compressed measurement value, wherein the compressed measurement value contains fewer bits than would be used to assign unique combinations of bits for a full possible range at the second resolution; transmitting, with the wireless telemetry module 132 of the bottom-hole-assembly 131 using wireless telemetry, the compressed measurement value; and decoding, with the processor 406 of the surface computer system 144 outside of the wellbore 101, the compressed measurement value.

Though exemplary methods have been described separately herein, it will be understood that components of any method may be used in combination with any other method and that not all steps of the methods are required, unless specifically stated as such.

From the above description, it is clear that the inventive concept(s) disclosed herein are well adapted to carry out the objects and to attain the advantages mentioned herein, as well as those inherent in the inventive concept(s) disclosed herein. While the embodiments of the inventive concept(s) disclosed herein have been described for purposes of this disclosure, it will be understood that numerous changes may be made and readily suggested to those skilled in the art which are accomplished within the scope and spirit of the inventive concept(s) disclosed herein.

Illustrative Clauses

Clause 1. A method, comprising: obtaining, using one or more sensors of a measurement-while-drilling (MWD) tool of a bottom-hole-assembly in a wellbore, a measurement value of a downhole parameter, the measurement value being within a full possible range for the measurement value having a first number of discrete values within the full possible range and having a first resolution indicative of a difference in quantity between each of the discrete values within the full possible range, wherein a bigger difference results in a lesser resolution and wherein a smaller difference results in a greater resolution, wherein the full possible range is associated with a transmission length level based on a full quantity of bits needed to transmit the measurement value in the full possible range, the full quantity of bits indicative of a minimum number of bits needed in a combination of bits in order to assign a unique combination of bits to each of the first quantity of discrete values; determining, with a processor of the MWD tool, an encoding format having a compression level for the measurement value by: comparing the measurement value to one or more predefined ranges within the full possible range, with each predefined range associated with a separate encoding format, each predefined range defined by a corresponding compressed quantity of predefined discrete, wherein the compression level of each encoding format is indicative of a corresponding compression quantity of bits needed to transmit the measurement value, wherein the compression quantity of bits is less than the full quantity of bits; and choosing the encoding format associated with the predefined range with the smallest size into which the measurement value fits of the one or more predefined ranges; applying, with the processor of the MWD Tool, the determined encoding format to the measurement value to generate a compressed measurement value; transmitting, with a wireless telemetry module of the bottom-hole-assembly using wireless telemetry, the compressed measurement value; and decoding, with a processor of a computer outside of the well, the compressed measurement value.

Clause 2. The method of Clause 1, wherein the compression quantity of bits is indicative of a minimum number of bits needed in a combination of bits in order to assign a unique combination of bits to each of the compressed quantity of predefined values defining the predefined range.

Clause 3. The method of Clause 1, wherein the predefined range with the smallest size is based on a difference between a highest predefined value in the predefined range and a lowest predefined value in the predefined range.

Clause 4. The method of Clause 1, wherein the compressed quantity of predefined discrete values of each of the one or more predefined ranges has a corresponding second resolution, wherein the second resolution is indicative of a difference in quantity between each of the discrete values within the corresponding predefined range, wherein the first resolution is less than the second resolution such that the difference between each of the discrete values within the full possible range is greater than the difference between each of the discrete values within the predefined ranges.

Clause 5. The method of Clause 4, wherein the compressed measurement value contains fewer bits than a third quantity of bits needed to assign unique combinations of bits for the full possible range at the second resolution.

Clause 6. The method of Clause 1, wherein the one or more predefined ranges include a first predefined range and a second predefined range, wherein the first predefined range is smaller than and within the second predefined range, and wherein determining, with the processor of the MWD tool, the encoding format having the compression level for the measurement value, comprises: comparing the measurement value to at least the first predefined range and the second predefined range; and choosing the encoding format associated with the smallest range of the first predefined range and the second predefined range in which the measurement value fits, as the determined encoding format for the measurement value.

Clause 7. The method of Clause 1, wherein the one or more predefined ranges include a first predefined range, a second predefined range, and a third predefined range, wherein the first predefined range is smaller than and within the second predefined range, and wherein the second predefined range is smaller than and within the third predefined range.

Clause 8. The method of Clause 1, further comprising: generating, with the processor of the MWD tool, a decode key identifying a decoding format operable to decode the compressed measurement value into the measurement value; and transmitting the decoding key using the wireless telemetry to the processor of the computer outside of the well; and wherein decoding, with the processor of the computer outside of the well, the compressed measurement value into the measurement value, comprises utilizing the decoding format identified with the decode key.

Clause 9. The method of Clause 8, wherein transmitting the decode key occurs prior to transmitting the compressed measurement value.

Clause 10. The method of Clause 8, wherein transmitting the decode key occurs after transmitting the compressed measurement value.

Clause 11. The method of Clause 1, comprising: utilizing the decoded measurement value to determine an orientation of the wellbore.

Clause 12. The method of Clause 11, comprising: steering the wellbore based on the determined orientation and a desired orientation.

Clause 13. The method of Clause 1, comprising: utilizing the decoded measurement value to validate accuracy of a set of measurements.

Clause 14. The method of Clause 8, comprising: scanning, with the processor of the computer outside of the well, a transmission from the processor of the MWD tool for the decode key.

Clause 15. The method of Clause 8, wherein the decode key is a first decode key and the compressed measurement value is a first measurement value, the method comprising: decoding, with the processor of the computer outside of the well, second compressed measurement values transmitted from the processor of the MWD tool utilizing the decoding format identified with the first decode key; identifying, with the processor of the computer outside of the well, a second decode key in a second transmission from the processor of the MWD tool; and decoding, with the processor of the computer outside of the well, third compressed measurement values transmitted from the processor of the MWD tool utilizing the decoding format identified with the second decode key.

Clause 16. The method of Clause 1, wherein the downhole parameter is indicative of an orientation of a drill bit of the bottom-hole-assembly.

Clause 17. The method of Clause 1, wherein the measurement value is one or more of: an azimuth value and an inclination value.

Clause 18. The method of Clause 1, wherein the measurement value of the downhole parameter is a first measurement value of a series of measurement values obtained from the one or more sensors at a first time of distinct instants of time, and wherein the method comprises: obtaining, using the one or more sensors in the bottom-hole-assembly, a second measurement value at a second time distinct from the first time; determining, with the processor of the MWD tool, a second encoding format having a second compression level for the second measurement value by comparing the second measurement value to the one or more predefined ranges; applying, with the processor of the MWD tool, the second encoding format to the second measurement value to generate a second compressed measurement value; generating, with the processor of the MWD tool, a second decode key based on the second encoding format; transmitting, with the wireless telemetry module of the bottom-hole-assembly using wireless telemetry, the second decode key and the second compressed measurement value; and decoding, with the processor of the computer outside of the well, the second compressed measurement value using the second decode key.

Clause 19. The method of Clause 18, comprising: utilizing the decoded second measurement value to determine an orientation of the wellbore.

Clause 20. The method of Clause 1, wherein the measurement value is a first measurement value, the method comprising: obtaining, using the one or more sensors, a second measurement value; determining, with a processor of the MWD tool, an encoding format having a compression level for the second measurement value by comparing the second measurement value to one or more predefined ranges within a full possible range for the second measurement value, with each predefined range associated with a separate encoding format, wherein the compression level of each encoding format for the second measurement value is indicative of a corresponding third number of bits needed to transmit the second measurement value, wherein for each compression level the third number of bits is indicative of a minimum number of bits needed in order to assign a unique combination of bits to each of a third number of predefined values defining the predefined range for that compression level; comparing the compression level of the determined encoding format level for the second measurement value to the compression level of the first measurement value by comparing the second number of bits to the third number of bits; changing the determined encoding format for the second measurement value to a second encoding format for the second measurement value having a different compression level, such that the third number of bits equals the second number of bits; applying the second encoding format to the second measurement value to generate a second compressed measurement value; and transmitting, with the wireless telemetry module of the bottom-hole-assembly using wireless telemetry, the second compressed measurement value.

Clause 21. The method of Clause 20, wherein decoding the compressed measurement value comprises utilizing a set decode key, the method comprising: decoding, with the processor of the computer outside of the well, the second compressed measurement value with the set decode key.

Clause 22. The method of Clause 21, comprising: obtaining, using the one or more sensors, a set of measurement values; determining, with the processor of the MWD tool, that the range of at least one measurement value of the set of measurement values meets a predetermined acceptable range; flagging, with the processor of the MWD tool, one or more measurement values of the set of measurement values with the range that meets the predetermined acceptable range, with one or more data flags; generating the set decode key to include the one or more data flags; and decoding, with the processor outside of the well, the one or more data flags using the set decode key, thereby determining which of the one or more measurement values are flagged.

Clause 23. A method, comprising: obtaining, using one or more sensors in a measurement-while-drilling (MWD) tool of a bottom-hole-assembly in a wellbore, a set of measurement values; determining, with a processor of the MWD tool, an encoding format of each measurement value of the set of measurement values, each of the determined encoding formats comprising a range and comprising a compression level designed to encode the corresponding measurement value at a required resolution; applying, with the processor of the MWD tool, the corresponding determined encoding format to each of the measurement values of the set of measurement values to generate a compressed measurement value for each of the measurement values; generating, with the processor of the MWD tool, a set decode key based on the encoding formats; transmitting, with a wireless telemetry module of the bottom-hole-assembly using wireless telemetry, the set decode key and the compressed measurement values; and decoding, with a processor outside of the well, the compressed measurement values using the set decode key.

Clause 24. The method of Clause 23, wherein the set decode key includes all of the encoding formats for all of the measurement values of the set of measurement values.

Clause 25. The method of Clause 23, comprising: utilizing one or more of the decoded measurement values to validate accuracy of one or more of the measurement values.

Clause 26. The method of Clause 23, comprising: utilizing one or more of the decoded measurement values to determine an orientation of the wellbore.

Clause 27. A method, comprising: obtaining, using one or more sensors in a measurement-while-drilling (MWD) tool of a bottom-hole-assembly in a well, a set of measurement values; determining, with a processor of the MWD tool, an encoding format of each measurement value of the set of measurement values, each of the determined encoding formats comprising a range and comprising a compression level designed to encode the corresponding measurement value at a required resolution; applying, with the processor of the MWD tool, the corresponding determined encoding format to each of the measurement values of the set of measurement values to generate a compressed measurement value for each of the measurement values; generating, with the processor of the MWD tool, two or more decode keys based on the encoding formats; transmitting, with a wireless telemetry module of the bottom-hole-assembly using wireless telemetry, the two or more decode keys and the compressed measurement values; and decoding, with a processor outside of the well, the compressed measurement values using the two or more decode keys.

Clause 28. The method of Clause 26, comprising: utilizing one or more of the decoded measurement values to validate accuracy of one or more of the measurement values.

Clause 29. The method of Clause 26, comprising: utilizing one or more of the decoded measurement values to determine an orientation of the wellbore.

Clause 30. The method of Clause 27, wherein the two or more decode keys comprise a first decode key and a second decode key, wherein the first decode key is indicative of the compression level and range of a first compressed measurement value of the compressed measurement values and wherein the second decode key is indicative of the compression level and range of a second compressed measurement value of the compressed measurement values.

Clause 31. A method, comprising: obtaining, using one or more sensors in a measurement-while-drilling (MWD) tool of a bottom-hole-assembly in a wellbore, one or more measurement values; determining, with a processor of the MWD tool, that the one or more measurement values meets a predetermined acceptable range; generating, with the processor of the MWD tool, a data flag indicative of the one or more measurement values meeting the predetermined acceptable range; transmitting, with a wireless telemetry module of the bottom-hole-assembly using wireless telemetry, the data flag; and decoding, with a processor outside of the well, the data flag, thereby determining that a current range of the measurement values meets the predetermined acceptable range, without receiving the one or more measurement values from the processor of the MWD tool.

Clause 32. The method of Clause 31, wherein the data flag is one bit.

Clause 33. The method of Clause 31, comprising: utilizing the decoded data flag to validate accuracy of one or more of the measurement values.

Clause 34. The method of Clause 31, wherein the one or more measurement values are one or more first measurement values, the method further comprising: obtaining, using the one or more sensors in the MWD tool of the bottom-hole-assembly in the well, one or more second measurement values; determining, with the processor of the MWD tool, that the one or more second measurement values is outside of the predetermined acceptable range; and transmitting, with the wireless telemetry module of the bottom-hole-assembly using wireless telemetry, the one or more second measurement values to the processor outside of the well.

Clause 35. The method of Clause 31, wherein the one or more measurement values are one or more first measurement values, the method further comprising: obtaining, using the one or more sensors in the MWD tool of the bottom-hole-assembly in the well, one or more second measurement values; determining, with the processor of the MWD tool, that a second current range of the second measurement values is outside of the predetermined acceptable range; determining, with the processor of the MWD tool, an encoding format of the one or more second measurement values, the determined encoding format comprising a range and comprising a compression level designed to encode the one or more second measurement values at a required resolution; applying, with the processor of the MWD tool, the determined encoding format to the one or more second measurement values to generate one or more compressed second measurement values; generating, with the processor of the MWD tool, one or more decode keys based on the encoding formats; transmitting, with the wireless telemetry module of the bottom-hole-assembly using wireless telemetry, the one or more decode keys and the one or more compressed second measurement values; and decoding, with the processor outside of the well, the one or more compressed second measurement values using the one or more decode keys.

Clause 36. A system, comprising: a bottom hole assembly comprising a measurement-while-drilling (MWD) tool comprising: a wireless telemetry module; one or more sensors; a MWD processor; and one or more nontransitory computer readable medium storing instructions that when executed by the MWD processor cause the MWD processor to: obtain, from the one or more sensors, a measurement value of a downhole parameter; determine an encoding format for the measurement value by comparing the measurement value to at least two ranges with each range associated with a separate encoding format having a compression level; apply the determined encoding format to the measurement value to generate a compressed measurement value; and transmit, utilizing the wireless telemetry module using wireless telemetry, the compressed measurement value; and a surface computer system having one or more processors configured to: decode the compressed measurement value; and utilize the decoded measurement value to determine an orientation of a wellbore.

Clause 37. A method, comprising: obtaining, using one or more sensors of a measurement-while-drilling (MWD) tool of a bottom-hole-assembly in a wellbore of a well, a measurement value of a downhole parameter; determining, with a processor of the MWD tool, an encoding format having a compression level for the measurement value by comparing the measurement value to at least two predefined ranges, with each predefined range associated with a separate encoding format; compressing, with the processor of the MWD Tool, the measurement value to generate a compressed measurement value using the determined encoding format; transmitting, with a wireless telemetry module of the bottom-hole-assembly using wireless telemetry, the compressed measurement value; and decoding, with a processor of a computer outside of the well, the compressed measurement value.

Clause 38. The method of Clause 37, wherein the at least two predefined ranges include a first predefined range and a second predefined range, wherein the first predefined range is smaller than and within the second predefined range, with each predefined range associated with a separate encoding format, and wherein determining, with the processor of the MWD tool, the encoding format having the compression level for the measurement value, comprises: comparing the measurement value to at least the first predefined range and the second predefined range; and choosing the encoding format associated with the smallest range of the first predefined range and the second predefined range in which the measurement value fits, as the determined encoding format for the measurement value.

Clause 39. The method of Clause 37, wherein the at least two predefined ranges include a first predefined range, a second predefined range, and a third predefined range, wherein the first predefined range is smaller than and within the second predefined range, and wherein the second predefined range is smaller than and within the third predefined range.

Clause 40. The method of Clause 37, wherein the measurement value has a first transmit length having a first number of bits, and wherein the compressed measurement value has a second transmit length having a second number of bits less than the first number of bits, thereby reducing a time for transmitting the compressed measurement value.

Clause 41. The method of Clause 37, wherein compressing the measurement value to generate the compressed measurement value using the determined encoding format further comprises translating the measurement value into two or more bits that represent the measurement value within an expected range of values, the expected range of values less than a total possible range of values.

Clause 42. The method of Clause 37, further comprising: generating, with the processor of the MWD tool, a decode key identifying a decoding format operable to decode the compressed measurement value; and transmitting the decoding key using the wireless telemetry to the processor of the computer outside of the wellbore; and wherein decoding, with the processor of the computer outside of the wellbore, the compressed measurement value, comprises utilizing the decoding format identified with the decode key.

Clause 43. The method of Clause 42, wherein transmitting the decode key occurs prior to transmitting the compressed measurement value.

Clause 44. The method of Clause 42, wherein transmitting the decoding key occurs after transmitting the compressed measurement value.

Clause 45. The method of Clause 42, comprising: utilizing the decoded measurement value to determine an orientation of the wellbore.

Clause 46. The method of Clause 42, comprising: utilizing the decoded measurement value to validate accuracy of a set of measurements.

Clause 47. The method of Clause 45, comprising: steering the wellbore based on the determined orientation and a desired orientation.

Clause 48. The method of Clause 42, comprising: scanning, with the processor of the computer outside of the wellbore, a transmission from the processor of the MWD tool for the decode key.

Clause 49. The method of Clause 42, wherein the decode key is a first decode key and the compressed measurement value is a first measurement value, the method comprising: decoding, with the processor of the computer outside of the wellbore, second compressed measurement values transmitted from the processor of the MWD tool utilizing the decoding format identified with the first decode key; identifying, with the processor of the computer outside of the wellbore, a second decode key in a second transmission from the processor of the MWD tool; and decoding, with the processor of the computer outside of the wellbore, third compressed measurement values transmitted from the processor of the MWD tool utilizing the decoding format identified with the second decode key.

Clause 50. The method of cl Clause 37, wherein the downhole parameter is indicative of an orientation of a drill bit of the bottom-hole-assembly.

Clause 51. The method of Clause 37, wherein the measurement value is one or more of: an azimuth value, a gravity value, an inclination value, a position value, a temperature value, a voltage value, a dip angle, and a magnetic field value.

Clause 52. The method of Clause 37, wherein the measurement value of the downhole parameter is a first measurement value of a series of measurement values obtained from the one or more sensors at a first time of distinct instants of time, and wherein the method comprises: obtaining, using the one or more sensors in the bottom-hole-assembly, a second measurement value at a second time distinct from the first time; determining, with the processor of the MWD tool, a second encoding format having a second compression level for the second measurement value by comparing the second measurement value to the at least two ranges, with each range associated with a separate encoding format; compressing, with the processor of the MWD tool, the second measurement value to generate a second compressed measurement value using the second compression level associated with the second encoding format; generating, with the processor of the MWD tool, a second decode key based on the second encoding format; transmitting, with the wireless telemetry module of the bottom-hole-assembly using wireless telemetry, the second decode key and the second compressed measurement value; and decoding, with the processor of the computer outside of the wellbore, the second compressed measurement value using the second decode key.

Clause 53. The method of Clause 52, comprising: utilizing the decoded second measurement value to determine an orientation of the wellbore.

Clause 54. A method, comprising: obtaining, using one or more sensors in a measurement-while-drilling (MWD) tool of a bottom-hole-assembly in a wellbore, a set of measurement values; determining, with a processor of the MWD tool, an encoding format of each measurement value of the set of measurement values, each of the determined encoding formats comprising a range and comprising a compression level designed to encode the corresponding measurement value at a required resolution; choosing, with the processor of the MWD tool, a chosen encoding format of the determined encoding formats having a lowest compression level of the determined encoding formats; determining, with the processor of the MWD tool, that the range of at least one of the measurement values of the set of measurement values meets a predetermined acceptable range; flagging, with the processor of the MWD tool, one or more measurement values of the set of measurement values with the range that meets the predetermined acceptable range, with one or more data flags; compressing, with the processor of the MWD tool using the lowest compression level, each of the measurement values of the set of measurement values, except the flagged one or more measurement values, to generate a compressed measurement value for each of the measurement values of the set of measurement values, except the flagged one or more measurement values; generating, with the processor of the MWD tool, a set decode key based on the chosen encoding format and including the one or more data flags; transmitting, with a wireless telemetry module of the bottom-hole-assembly using wireless telemetry, the set decode key and the compressed measurement values; and decoding, with a processor outside of the wellbore, the compressed measurement values and the one or more data flags using the set decode key.

Clause 55. The method of Clause 54, comprising: interpreting, with the processor outside of the wellbore, the one or more data flags to mean that the flagged one or more measurement values of the set of measurement values meet the predetermined acceptable range, without receiving the flagged one or more measurement values from the processor of the MWD tool.

Clause 56. The method of Clause 55, comprising: utilizing one or more of the decoded measurement values and the interpreted one or more data flags to determine an orientation of the wellbore.

Clause 57. A method, comprising: obtaining, using one or more sensors in a measurement-while-drilling (MWD) tool of a bottom-hole-assembly in a wellbore of a well, a set of measurement values; determining, with a processor of the MWD tool, an encoding format of each measurement value of the set of measurement values, each of the determined encoding formats comprising a range and comprising a compression level designed to encode the corresponding measurement value at a required resolution; choosing, with the processor of the MWD tool, a chosen encoding format of the determined encoding formats having a lowest compression level of the determined encoding formats, the lowest compression level being the compression level that allows all of the measurement values in the set of measurement values to have a same compression level and the required resolution; compressing, with the processor of the MWD tool using the lowest compression level, each of the measurement values of the set of measurement values to generate a compressed measurement value for each of the measurement values; generating, with the processor of the MWD tool, a set decode key based on the chosen encoding format; transmitting, with a wireless telemetry module of the bottom-hole-assembly using wireless telemetry, the set decode key and the compressed measurement values; and decoding, with a processor outside of the wellbore, the compressed measurement values using the set decode key.

Clause 58. The method of Clause 57, comprising: utilizing one or more of the decoded measurement values to determine an orientation of a wellbore of the well.

Clause 59. The method of Clause 57, wherein the set of measurement values is a first set of measurement values, the method comprising: obtaining, using the one or more sensors in the MWD tool of the bottom-hole-assembly in a wellbore of the well, a second set of measurement values; compressing, with the processor of the MWD tool using the lowest compression level, each of the measurement values of the second set of measurement values to generate a compressed measurement value for each of the measurement values of the second set of measurement values; transmitting, with a wireless telemetry module of the bottom-hole-assembly using wireless telemetry, the compressed measurement values for each of the measurement values of the second set of measurement values; and decoding, with the processor outside of the wellbore, the compressed measurement values for each of the measurement values of the second set of measurement values using the set decode key.

Clause 60. The method of Clause 57, comprising: determining, with the processor of the MWD tool, that the range of at least one of the measurement values of the set of measurement values meets a predetermined acceptable range; flagging, with the processor of the MWD tool, one or more measurement values of the set of measurement values with the range that meets the predetermined acceptable range, with one or more data flags; generating the set decode key to include the one or more data flags; and decoding, with the processor outside of the wellbore, the one or more data flags using the set decode key.

Clause 61. A method, comprising: obtaining, using one or more sensors in a measurement-while-drilling (MWD) tool of a bottom-hole-assembly in a wellbore, a set of measurement values; determining, with a processor of the MWD tool, an encoding format of each measurement value of the set of measurement values, each of the determined encoding formats comprising a range and comprising a compression level designed to encode the corresponding measurement value at a required resolution; compressing, with the processor of the MWD tool, each of the measurement values of the set of measurement values using the corresponding compression level to generate a compressed measurement value for each of the measurement values; generating, with the processor of the MWD tool, a set decode key based on the encoding formats; transmitting, with a wireless telemetry module of the bottom-hole-assembly using wireless telemetry, the set decode key and the compressed measurement values; and decoding, with a processor outside of the wellbore, the compressed measurement values using the set decode key.

Clause 62. The method of Clause 61, wherein the set decode key includes all of the encoding formats for all of the measurement values of the set of measurement values.

Clause 63. The method of Clause 61, comprising: utilizing one or more of the decoded measurement values to determine an orientation of the wellbore.

Clause 64. A method, comprising: obtaining, using one or more sensors in a measurement-while-drilling (MWD) tool of a bottom-hole-assembly in a wellbore of a well, a set of measurement values; determining, with a processor of the MWD tool, an encoding format of each measurement value of the set of measurement values, each of the determined encoding formats comprising a range and comprising a compression level designed to encode the corresponding measurement value at a required resolution; compressing, with the processor of the MWD tool, each of the measurement values of the set of measurement values using the corresponding compression level to generate a compressed measurement value for each of the measurement values; generating, with the processor of the MWD tool, two or more decode keys based on the encoding formats; transmitting, with a wireless telemetry module of the bottom-hole-assembly using wireless telemetry, the two or more decode keys and the compressed measurement values; and decoding, with a processor outside of the wellbore, the compressed measurement values using the two or more decode keys.

Clause 65. The method of Clause 64, comprising: utilizing one or more of the decoded measurement values to determine an orientation of a wellbore of the wellbore.

Clause 66. The method of Clause 64, wherein the two or more decode keys comprise a first decode key and a second decode key, wherein the first decode key is indicative of the compression level and range of a first compressed measurement value of the compressed measurement values and wherein the second decode key is indicative of the compression level and range of a second compressed measurement value of the compressed measurement values.

Clause 67. A method, comprising: obtaining, using one or more sensors in a measurement-while-drilling (MWD) tool of a bottom-hole-assembly in a wellbore, one or more measurement values; determining, with a processor of the MWD tool, that the one or more measurement values meets a predetermined acceptable range; generating, with the processor of the MWD tool, a data flag indicative of the one or more measurement values meeting the predetermined acceptable range; transmitting, with a wireless telemetry module of the bottom-hole-assembly using wireless telemetry, the data flag; and decoding, with a processor outside of the wellbore, the data flag, thereby determining that the current range of the measurement values meets the predetermined acceptable range, without receiving the one or more measurement values from the processor of the MWD tool.

Clause 68. The method of Clause 67, wherein the data flag is one bit.

Clause 69. The method of Clause 67, comprising: utilizing the decoded data flag to determine an orientation of the wellbore.

Clause 70. The method of Clause 67, wherein the one or more measurement values are one or more first measurement values, the method further comprising: obtaining, using the one or more sensors in the MWD tool of the bottom-hole-assembly in the wellbore, one or more second measurement values; determining, with the processor of the MWD tool, that the one or more second measurement values is outside of the predetermined acceptable range; and transmitting, with the wireless telemetry module of the bottom-hole-assembly using wireless telemetry, the one or more second measurement values to the processor outside of the wellbore.

Clause 71. The method of Clause 67, wherein the one or more measurement values are one or more first measurement values, the method further comprising: obtaining, using the one or more sensors in the MWD tool of the bottom-hole-assembly in the wellbore, one or more second measurement values; determining, with the processor of the MWD tool, that a second current range of the second measurement values is outside of the predetermined acceptable range; determining, with the processor of the MWD tool, an encoding format of the one or more second measurement values, the determined encoding format comprising a range and comprising a compression level designed to encode the one or more second measurement values at a required resolution; compressing, with the processor of the MWD tool, the one or more second measurement values using the compression level to generate one or more compressed second measurement values; generating, with the processor of the MWD tool, one or more decode keys based on the encoding formats; transmitting, with the wireless telemetry module of the bottom-hole-assembly using wireless telemetry, the one or more decode keys and the one or more compressed second measurement values; and decoding, with the processor outside of the wellbore, the one or more compressed second measurement values using the one or more decode keys.

Clause 72. A system, comprising: a processor of a surface computer system; and a bottom hole assembly comprising a measurement-while-drilling (MWD) tool comprising: a wireless telemetry module; one or more sensors; a MWD processor; and one or more nontransitory computer readable medium storing instructions that when executed by the MWD processor cause the MWD processor to: obtain, from the one or more sensors, a measurement value of a downhole parameter; determine an encoding format for the measurement value by comparing the measurement value to at least two ranges with each range associated with a separate encoding format having a compression level; compress the measurement value to generate a compressed measurement value using the encoding format associated with the measurement value; and transmit, utilizing the wireless telemetry module using wireless telemetry, the compressed measurement value; and wherein the processor of the surface computer system is configured to decode the compressed measurement value and to utilize the decoded measurement value to determine an orientation of a wellbore.

Clause 73: A method for encoding a group of two or more measurement values using a shared compression format, comprising: evaluating, with a processor of a MWD tool, each measurement value in a group of two or more measurement values to determine the most efficient compression format that can represent each measurement value within a valid encoding range; identifying, among the individually selected formats, the least efficient format wherein the least efficient format is the format having the broadest range, and applying the least efficient format uniformly to all values in the group, the shared, lease efficient format ensuring that each measurement value is be efficiently encoded without exceeding an allowable range for the measurement value; generating and transmitting a decode key indicative of the compression format used for the group of two or more measurement values, thereby enabling a surface computer system to correctly interpret the encoded values.

Clause 74: A method, comprising: designating, with a processor of a MWD tool, certain compression levels as representing an acceptable range, rather than transmitting a specific quantitative value from the MWD tool to a surface computer system.

Clause 75: The method of Clause 74, comprising: determining, with a processor of a MWD tool, that a measurement value of a measured variable falls within a predefined acceptable range; assigning, with the processor of the MWD tool, a particular compression level that corresponds to that range; transmitting to a surface computer system a decode key without transmitting any actual measurement data; wherein the decode key is indicative that the particular compression level is in use, thereby signaling to the surface computer system that the measurement value of the measured variable is within the predefined acceptable range. As a result, the system does not need to receive a separate numeric value, thus optimizing transmission efficiency while ensuring that the surface software can still interpret the data accurately.

What is claimed is:

1. A method, comprising:

obtaining, using one or more sensors of a measurement-while-drilling (MWD) tool of a bottom-hole-assembly in a wellbore of a well, the one or more sensors including at least one accelerometer, the sensors positioned proximate to a drill bit of the bottom-hole-assembly in the wellbore, a measurement value of a downhole parameter, the measurement value being within a full possible range for the measurement value having a first number of discrete values within the full possible range and having a first resolution indicative of a difference in quantity between each of the discrete values within the full possible range, wherein a bigger difference results in a lesser resolution and wherein a smaller difference results in a greater resolution, wherein the full possible range is associated with a transmission length level based on a full quantity of bits needed to transmit the measurement value in the full possible range, the full quantity of bits indicative of a minimum number of bits needed in a combination of bits in order to assign a unique combination of bits to each of the full quantity of discrete values;

determining, with a processor of the MWD tool, an encoding format having a compression level for the measurement value by:

comparing the measurement value to one or more predefined ranges within the full possible range, with each predefined range associated with a separate encoding format, each predefined range defined by a corresponding compressed quantity of predefined discrete values, wherein the compression level of each encoding format is indicative of a corresponding compression quantity of bits needed to transmit the measurement value, wherein the compression quantity of bits is less than the full quantity of bits; and choosing the encoding format associated with the predefined range with the smallest size into which the measurement value fits of the one or more predefined ranges;

applying, with the processor of the MWD Tool, the determined encoding format to the measurement value to generate a compressed measurement value comprising the compression quantity of bits;

transmitting, with a wireless telemetry module of the bottom-hole-assembly using wireless telemetry utilizing a pulse system, the compressed measurement value, wherein transmitting the compressed measurement value comprising the compression quantity of bits requires less transmission time than transmitting the measurement value using the full quantity of bits would require;

decoding, with a processor of a computer outside of the wellbore, the compressed measurement value; and utilizing the decoded compressed measurement value to guide the drill bit in the well.

2. The method of claim 1, wherein the compression quantity of bits is indicative of a minimum number of bits needed in a combination of bits in order to assign a unique combination of bits to each of the compressed quantity of predefined values defining the predefined range.

3. The method of claim 1, wherein the predefined range with the smallest size is based on a difference between a highest predefined value in the predefined range and a lowest predefined value in the predefined range.

4. The method of claim 1, wherein the compressed quantity of predefined discrete values of each of the one or more predefined ranges has a corresponding second resolution, wherein the second resolution is indicative of a difference in quantity between each of the discrete values within the corresponding predefined range, wherein the first resolution is less than the second resolution such that the difference between each of the discrete values within the full possible range is greater than the difference between each of the discrete values within the predefined ranges.

5. The method of claim 4, wherein the compressed measurement value contains fewer bits than a third quantity of bits needed to assign unique combinations of bits for the full possible range at the second resolution.

6. The method of claim 1, wherein the one or more predefined ranges include a first predefined range and a second predefined range, wherein the first predefined range is smaller than and within the second predefined range, and wherein determining, with the processor of the MWD tool, the encoding format having the compression level for the measurement value, comprises:

comparing the measurement value to at least the first predefined range and the second predefined range; and choosing the encoding format associated with the smallest range of the first predefined range and the second predefined range in which the measurement value fits, as the determined encoding format for the measurement value.

7. The method of claim 1, wherein the one or more predefined ranges include a first predefined range, a second predefined range, and a third predefined range, wherein the first predefined range is smaller than and within the second predefined range, and wherein the second predefined range is smaller than and within the third predefined range.

8. The method of claim 1, further comprising:

generating, with the processor of the MWD tool, a decode key identifying a decoding format operable to decode the compressed measurement value into the measurement value; and transmitting the decoding key using the wireless telemetry to the processor of the computer outside of the well; and wherein decoding, with the processor of the computer outside of the well, the compressed measurement value into the measurement value, comprises utilizing the decoding format identified with the decode key.

9. The method of claim 8, wherein transmitting the decode key occurs prior to transmitting the compressed measurement value.

10. The method of claim 8, wherein transmitting the decode key occurs after transmitting the compressed measurement value.

11. The method of claim 8, comprising:

scanning, with the processor of the computer outside of the well, a transmission from the processor of the MWD tool for the decode key.

12. The method of claim 8, wherein the decode key is a first decode key and the compressed measurement value is a first measurement value, the method comprising:

decoding, with the processor of the computer outside of the well, second compressed measurement values transmitted from the processor of the MWD tool utilizing the decoding format identified with the first decode key;

identifying, with the processor of the computer outside of the well, a second decode key in a second transmission from the processor of the MWD tool; and decoding, with the processor of the computer outside of the well, third compressed measurement values transmitted from the processor of the MWD tool utilizing the decoding format identified with the second decode key.

13. The method of claim 8, wherein the measurement value is a first measurement value, the method comprising:

obtaining, using the one or more sensors, a second measurement value;

determining, with the processor of the MWD tool, that the second measurement value is within a predetermined acceptable range;

flagging, with the processor of the MWD tool, the second measurement value with one or more data flags;

generating the decode key to include the one or more data flags; and decoding, with the processor outside of the well, the one or more data flags using the decode key, thereby determining that the second measurement value is within the predetermined acceptable range.

14. The method of claim 1, comprising:

utilizing the decoded measurement value to determine an orientation of the wellbore.

15. The method of claim 14, comprising:

steering the wellbore based on the determined orientation and a desired orientation.

16. The method of claim 1, comprising:

utilizing the decoded measurement value to validate accuracy of a set of measurements.

17. The method of claim 1, wherein the downhole parameter is indicative of an orientation of a drill bit of the bottom-hole-assembly.

18. The method of claim 1, wherein the measurement value of the downhole parameter is a first measurement value of a series of measurement values obtained from the one or more sensors at a first time of distinct instants of time, and wherein the method comprises:

obtaining, using the one or more sensors in the bottom-hole-assembly, a second measurement value at a second time distinct from the first time;

determining, with the processor of the MWD tool, a second encoding format having a second compression level for the second measurement value by comparing the second measurement value to the one or more predefined ranges;

applying, with the processor of the MWD tool, the second encoding format to the second measurement value to generate a second compressed measurement value;

generating, with the processor of the MWD tool, a second decode key based on the second encoding format;

transmitting, with the wireless telemetry module of the bottom-hole-assembly using wireless telemetry, the second decode key and the second compressed measurement value; and decoding, with the processor of the computer outside of the well, the second compressed measurement value using the second decode key.

19. The method of claim 18, comprising:

utilizing the decoded second measurement value to determine an orientation of the wellbore.

20. A system, comprising:

a bottom-hole-assembly comprising a measurement-while-drilling (MWD) tool comprising:

a wireless telemetry module configured to utilize a pulse system;

one or more sensors including at least one accelerometer, the one or more sensors positioned proximate to a drill bit of the bottom-hole-assembly;

a MWD processor; and one or more non-transitory computer readable medium storing instructions that when executed by the MWD processor cause the MWD processor to:

obtain, from the one or more sensors, a measurement value of a downhole parameter, the measurement value being within a full possible range associated with a full quantity of bits needed to transmit the measurement value over the full possible range;

determine an encoding format for the measurement value by comparing the measurement value to at least two ranges with each range associated with a separate encoding format having a compression level, the compression level of the determined encoding format being indicative of a compression quantity of bits that is fewer than the full quantity of bits;

apply the determined encoding format to the measurement value to generate a compressed measurement value comprising the compression quantity of bits; and transmit, utilizing the wireless telemetry module using wireless telemetry, the compressed measurement value, wherein transmitting the compressed measurement value comprising the compression quantity of bits requires less transmission time than transmitting the measurement value using the full quantity of bits would require; and a surface computer system having one or more processors configured to:

decode the compressed measurement value; and utilize the decoded measurement value to determine an orientation of a wellbore and to guide the drill bit in the well.

* * * * *